US005278554A

United States Patent [19]

Marton

[11] Patent Number: 5,278,554

[45] Date of Patent: Jan. 11, 1994

[54] ROAD TRAFFIC CONTROL SYSTEM WITH ALTERNATING NONSTOP TRAFFIC FLOW

[76] Inventor: Louis L. Marton, 401 Shirley Pl., No. 105, Beverly Hills, Calif. 90212

[21] Appl. No.: 870,100

[22] Filed: Apr. 20, 1992

Related U.S. Application Data

[63] Continuation-in-part of Ser. No. 680,912, Apr. 5, 1991, abandoned.

[51] Int. Cl.[5] ..... G08G 1/07

[52] U.S. Cl. ..... 340/910; 340/909; 340/911; 340/934; 340/917

[58] Field of Search ..... 340/910, 930, 934, 936, 340/933, 901, 917, 905, 933, 909, 911; 364/436-438; 180/167-170

[56] References Cited

U.S. PATENT DOCUMENTS

| | | | |
|---|---|---|---|
| 3,188,927 | 6/1965 | Woods | 340/932 |
| 3,302,168 | 1/1967 | Gray et al. | 340/932 |
| 3,529,284 | 9/1970 | Villemain | 340/932 |
| 3,544,959 | 12/1970 | Hawks | 340/932 |
| 3,750,099 | 7/1973 | Proctor | 340/932 |
| 3,872,423 | 3/1975 | Yeakley | 340/932 |

*Primary Examiner*—Donnie L. Crosland

[57] ABSTRACT

The central version of the road traffic control system maintains nonstop flow of traffic on selected lanes of fastroads (1A, 1B, 1C, 4A, 4B, 4C, 31A, 31B, 31C, 32A, 32B, 32C) all the time by grouping the vehicles in closed columns in moving travel zones alternating with empty zones, marked by fixtures (6) emitting zone marker signals controlled by central processor (7). Columns of vehicles are grouped in travel zones (21A, 21B, 33A, 33B) alternating with empty (vacate) zones (211, 331), and are laid out in a centrally controlled grid pattern of fastroads (1A, 1B, 4A, 4B, 31A, 31B, 32A, 32B). The control system guides the moving travel zones through the empty zones of the cross roads without stopping. In local version having light traffic, stopping is reduced and quasi-nonstop traffic flow is introduced on locally controlled crossings (41, 42) by sensor (45A, 45B, 46A, 64B, 46C) controlled traffic lights operated by local processor (47).

18 Claims, 10 Drawing Sheets

46
TL1
45
PS45
R
Y
G
45
46
TL2
PS46
SENSOR
SC1
AC1
SENSOR
S45A
A45A
SENSOR
S45B
A45B
SENSOR
S46A
A46A
SENSOR
S46B
A46B
AMPLIFIER
AMPLIFIER
AMPLIFIER
AMPLIFIER
R3
R5
R51
R6
R61
R1
R8
R2
R9
R7
T2-2
T2-1
63
62
TIMER
T2
T1-3
T1-4
60
T1-1
T1-2
61
TIMER
T1
PL

ROAD TRAFFIC CONTROL SYSTEM WITH ALTERNATING NONSTOP TRAFFIC FLOW

This application is a continuation-in-part of U.S. patent application, Ser. No. 07/680,912 filed Apr. 5, 1991, now abandoned.

BACKGROUND

Field of the Invention

This invention relates to traffic control systems primarily for controlling city traffic, in a grid of streets, secondarily, for street and road intersections presently controlled by stop signs.

BACKGROUND

Description of Prior Art

The conventional road traffic control systems based on visual red, green, and yellow light signals, and operate on the principle of alternating the right of way between intersecting streets. Thus they generate stop-and-go traffic flow in both streets. A predetermined time schedule is generally used for the changing of the signals. Recent improvements, using sensors and computers for control, introduced a flexible time schedule. This schedule is automatically adjusted in accordance with traffic requirements assigning longer time to the direction having the heavier traffic. This procedure serves the purpose of maximizing the preservation of the energy content of the moving vehicles by minimizing the energy converted into waste heat by the brakes at stops. (One of the most complex examples: U.S. Pat. No. 4,370,718, N. E. Chasek, published Jan. 25, 1983).

In older, less sophisticated controls, side streets often have a sensor controlled light with ample delay built in for the prevention of frequent interruption of the traffic on the main street. This method results in long waiting on the side street at the intersections, even when no traffic exists on the main street.

On some main streets the traffic lights are operated in accordance with the principles of the signal progression system, switching the successive lights in sequence for successive intersections, creating moving yellow, green, and red zones. The speed of the movement is usually fixed to the expected speed of the traffic under the worst conditions. This speed is posted in some cities, but it is often not, or ignored by some of the drivers. This procedure leads to situations where the traffic loses the wave of the progressing green signals, driving slower, or running into red light too fast, then piling up in a platoon waiting at the intersection. When a platoon has stopped, it would not start fast enough to catch up with the wave, thus it stops again at the next red light. They repeat this stop-and-go driving at every traffic light. But few of the drivers realize that if they would catch the green wave created by the progressing signals and match their speed to it, everyone would be able to cross downtown without stopping.

When the traffic gets heavy, more and more vehicles enter and overflow the capacity of the green zone. The overflow platoon waits at a red light, and when the green signals reach the area, the platoon starts accelerating, but it stretches out in the process. Thus only the front portion of the platoon can keep up with the progressing green lights; the rest of the overflow platoon get caught by the next red light. The result is that in somewhat heavier traffic, or even in light traffic, if some of the drivers does not keep up with the "system speed", the advantage of the signal progression system gets lost. Stop-and-go traffic will prevail.

There are traffic control systems in the prior art designed for controlling the speed of a platoon of vehicles between intersections by varying the repetition rate of a string of flashing lights arranged in zones along the road. (The best example is U.S. Pat. No. 3,529,284, C. A. Villemain, published Sep. 15, 1970). Their goal is to shift the arrival of the platoon to the moment when the intersection traffic light turns green. They subordinate the speed control of the platoon to the timing of the conventional intersection traffic lights. They don't specify the optimum length of the platoon relative to the distance between intersections for assuring the largest volume of traffic flow, or the layout patterns for platoons in a grid of streets for one way, or two way traffic for achieving this goal. They don't have any solution for the prevention of gridlock and saturation. They don't offer any teaching how to accomplish safe nonstop left turns in two way traffic, and nonstop traffic flow at intersections presently controlled by stop signs.

The movement of traffic is interrupted in both directions too often in every existing system. The most frequent reason is that the signal progression system is not used, poorly arranged, or disregarded. The green lights do not appear in wave, or the drivers are not aware of the velocity of the wave and the advantage to keep up with it. In addition, slightly heavier traffic leads to the overcrowding of the road with vehicles entering into the red zone and piling up at the next red light. This pile up prevents the next platoon arriving with the next green zone to progress with the green lights. They have to stop at the rear end of the first pile up.

Consequently, the conventional traffic control systems stop the flow of traffic too often converting a substantial part of the energy content of the vehicles into waste heat; it cannot smoothly handle the traffic situation any more in most of the larger cities. Gridlock is everyday occurrence, and the waste of time and fuel, and the amount of polluting exhaust are steadily rising.

On streets having light traffic, stop signs are used, sometimes in every block, in all four approaches. Most of the stops are unnecessary, because there is no approaching cross traffic. Still this ancient wasteful practice goes on. The development of highly reliable low cost control devices in recent decades is ignored, which could be used with great flexibility and the same degree of safety without unnecessary stopping. Stop-and-go operation of a motor vehicle without recuperative braking system requires 50–90% more fuel and uses up more brakes than driving at a steady speed, and wastes time. The air pollution, and the contribution to the greenhouse effect increases in the same proportion. The uselessly burned up fuel costs more in a year than the installation and maintenance of the low cost solid state control devices. The savings in driving time, and the reduction of environmental damages are the bonus.

In the prior art and literature a large number of sensor and processor operated improved traffic control systems can be found. All these systems, however, are mere improvements on some kind of stop-and-go system; non of them propose a nonstop alternating traffic flow protected against gridlock and saturation in accordance with the present invention. In the following, a road protected in this manner and controlled nonstop with signal progression will be referred to as "fastroad".

OBJECTS AND ADVANTAGES

In view of the foregoing, several objects and advantages of the present invention are:

(a) to provide a central traffic control system for city streets with increased safety that is capable of controlling traffic flow with steady speed without stopping or substantially slowing the flow on selected lanes of designated roads;

(b) to provide a safe central traffic control system that offers the advantage of protection against gridlock and saturation;

(c) to provide a safe central traffic control system that can be installed with very little investment in its simplest form;

(d) to provide a safe central traffic control system that can be installed on a wide multi-lane road just as well as on a two lane road;

(e) to provide a safe central traffic control system that offers the possibility for right and left turns and U-turns without stopping and waiting;

(f) to provide a safe central traffic control system that offers the possibility to park at the curb, or enter a drive way with a large vehicle without obstructing the traffic flow;

(g) to provide a safe central traffic control system that can handle truck and car traffic without leading to friction and lane changes;

(h) to provide a safe central traffic control system that creates no incentive for lane changes, except for entering and exiting;

(i) to provide a safe central traffic control system that can reduce accidents by reducing speed and lane changes;

(j) to provide a safe central traffic control system that can handle pedestrian traffic easier and safer;

(k) to provide a safe central traffic control system that can handle emergency vehicles without difficulty;

(l) to provide a safe local traffic control system as a substitute for conventional stop signs that permits nonstop light traffic in both directions most of the time;

(m) to provide a safe traffic control system that considerably increases the average speed of the flow with the same speed limit;

(n) to provide a safe traffic control system that substantially reduces the fuel consumption;

(o) to provide a safe traffic control system that reduces air pollution and greenhouse effect in the same proportion;

(p) to provide a safe traffic control system that reduces driving time, frustration, and related health problems.

(q) to provide an up-to-date economical traffic control system that will pay for its installation within one year by the unused fuel alone saved by the elimination of unnecessary stopping. Subsequent fuel savings and the reduction of wasted time and air pollution will be free.

Further objects and advantages will become apparent from a consideration of the ensuing description and drawings.

SUMMARY OF THE INVENTION

In two way traffic, the central traffic control system according to the present invention is applicable for any street having a minimum of one lane reserved for through (straight) traffic of motor vehicles, and has an additional lane in the same direction at the right edge of the road at the place of entering, exiting, and right turning. The presence of a left turn lane is not necessary; nonstop left turns are easy and safe at midway between two crossing fastroads.

In one way traffic, both right and left turns are feasible at any crossing from the curb lanes of a fastroad. The crossing of fastroads by vehicles and pedestrians is without restrictions more than half of the time.

In the following, a road operated with nonstop control system according to the present invention will be referred to as "fastroad", and the lane(s) for nonstop through traffic as "nonstop lane(s)". A multi-lane road may have both nonstop lanes and conventional lanes, if this arrangement has some advantages at the given conditions. A nonstop flow of traffic can be sustained on the nonstop lanes under normal road conditions by grouping the vehicles in closed platoons arranged with adequate gaps ("vacate zones") on the centrally controlled streets. The steady movement of these platoons in a grid of city streets can be maintained even while crossing intersecting roads. The intersection of two crossing fastroads will be referred to as "nonstop intersection". The distance between two subsequent nonstop intersections will be referred to as "fastblock". The crossing platoons are guided to pass through in each other's gaps in nonstop manner at every nonstop intersection without changing speed and without compromising safety.

In order to maintain alternating nonstop traffic flow on the nonstop lane(s), three moving zones (red, green, yellow) are marked along the fastroads by signal emitting fixtures (traffic lights in the most simple case) operated according to signal progression principles. These zones are moving with centrally controlled cycles all the time. The same number of signal emitting fixtures are installed between each nonstop intersection and operated by the central control device with the same frequency of cycling. In each cycle the signal progresses from one fixture to the next. The velocity of the progression is determined by the given distance of the fixtures at a given frequency. Thus, in an uneven grid of streets, the velocity may vary from block to block in accordance with the length of the fastblocks.

If the vehicles keep up with the progression of the travel zone, their nonstop speed also varies with the same proportion. If the distance is the same throughout the grid, the nonstop speed is the same throughout, and called "system speed".

Vehicles admitted to travel only in "travel zones". They form platoons in them and move with the nonstop speed on the nonstop lanes. To allow a maximum number of vehicles to travel nonstop in these travel zones, the fastroad system requires that the leading vehicle keeps up with the progression of the movement of the green signal and the travel zone, and the following vehicles keep minimum safe clearance from the preceding vehicle.

When the leading vehicle does not closely follow the progression of the green signal, and the following vehicles do not keep the minimum safe clearance leaving gaps in the platoon, the result is poorly utilized road capacity; ultimately the system reverts to a stop-and-go traffic flow.

In order to maintain the nonstop character of the fastroad system, in is absolutely essential to limit the presence of vehicles to the travel (green) zones in the nonstop lanes. If vehicles enter a nonstop lane when the red zone is moving through, ultimately they stopped by red light at the next intersection. When the legitimate platoon arrives with the green zone, it is forced to stop behind them. Thus the nonstop character is lost, and the familiar stop-and-go system is restored with saturation, congestion, and gridlock. By limiting the entry of vehicles to the green zones in nonstop lanes, fastroads are immune: they run the same way all the time regardless how many vehicles are waiting at the on ramps for entry.

Presently, the road traffic is controlled by colored lights almost exclusively. The direction of the development of advanced systems demonstrates that the next stage will be to eliminate the human link from the control chain and send microwave signals to automated vehicles directly, bypassing the driver. The present invention is eminently applicable in this advanced version.

DESCRIPTION OF THE PREFERRED EMBODIMENTS

Figure 1:
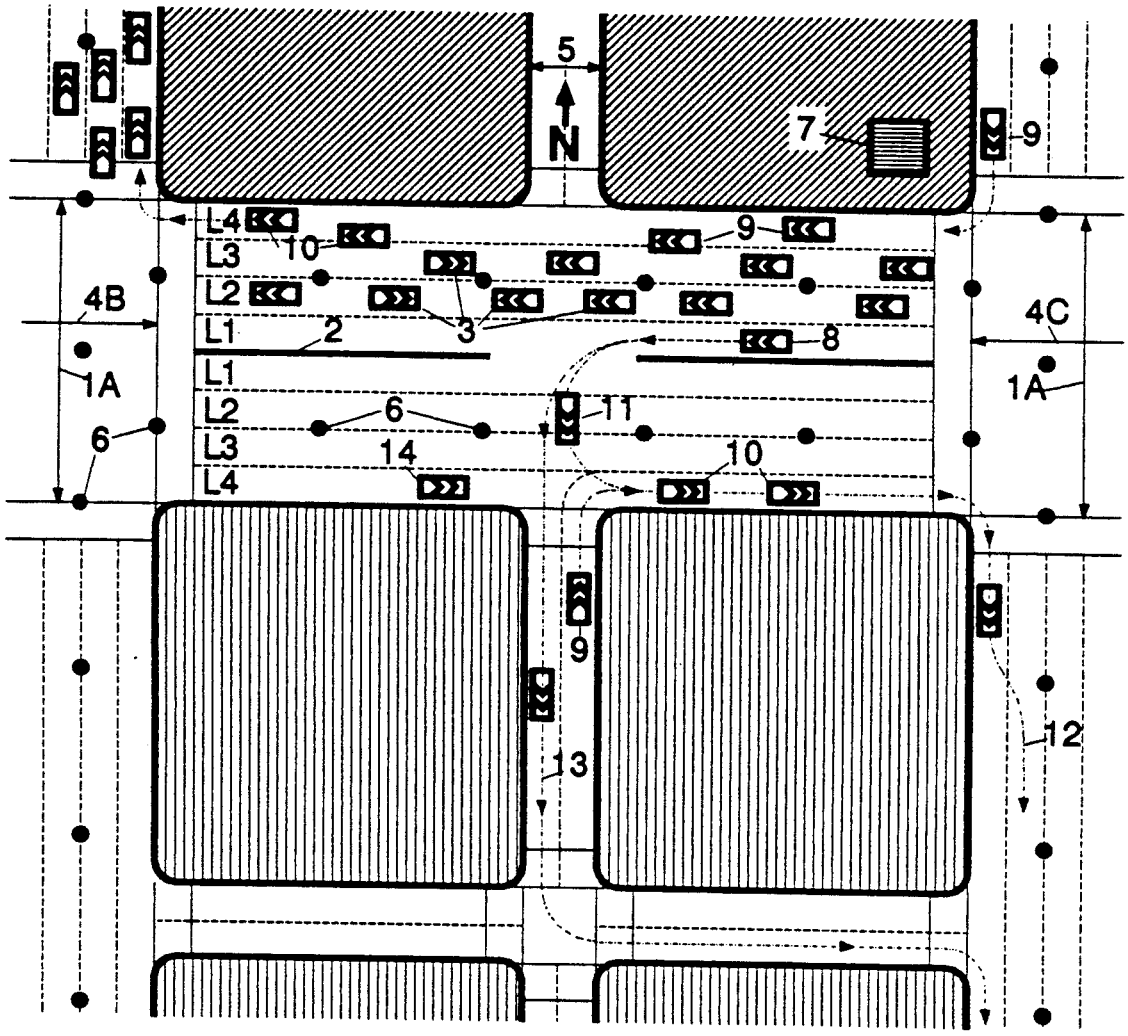
FIG. 1 shows a partial closeup view of several blocks of city streets with vehicles in an eight lane fastroad system, shown in a wider grid in FIG. 2.
Figure 2:
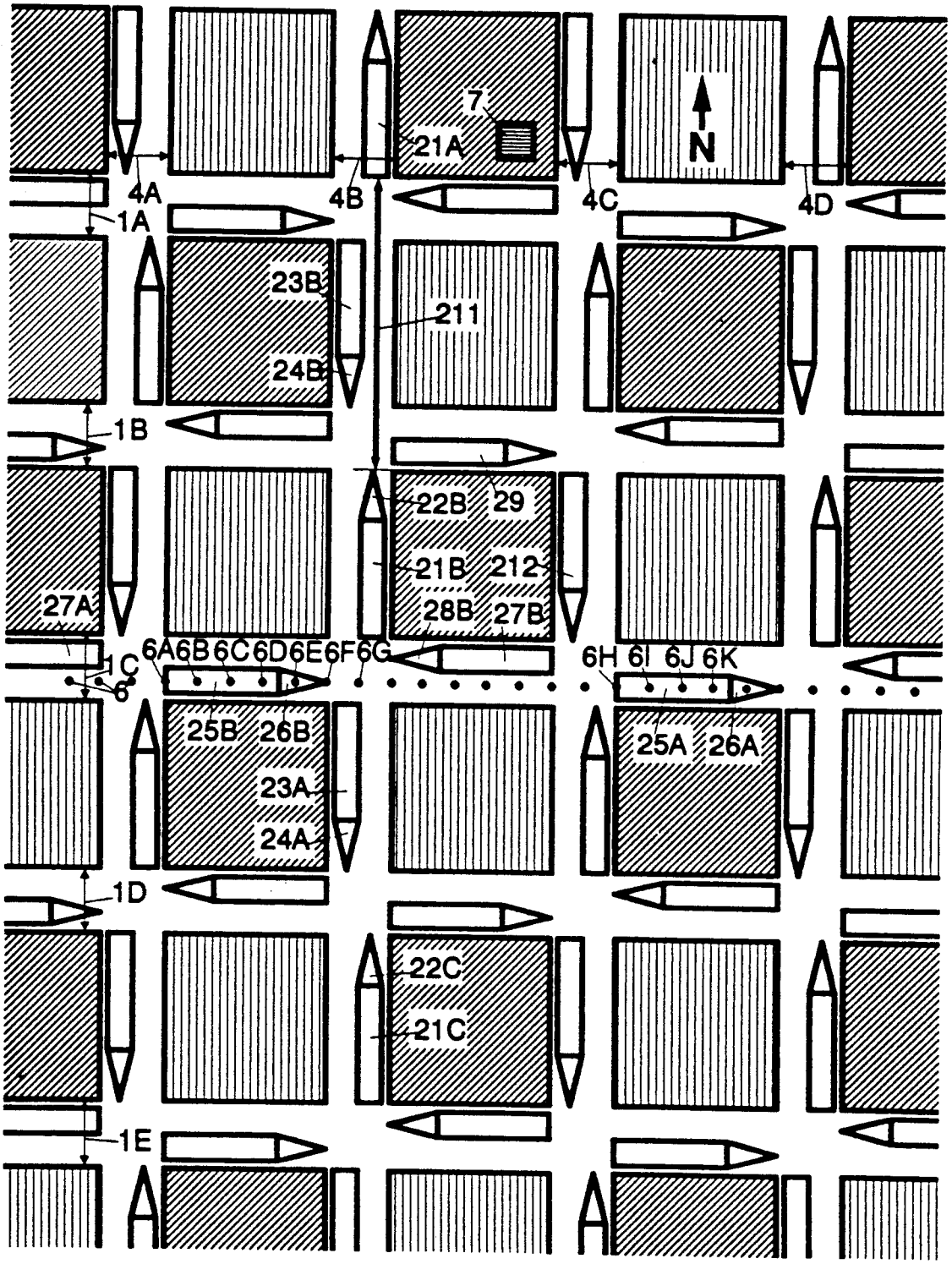
FIG. 2 shows a plan view of a grid of two way fastroads with the arrangement of zones.

FIG. 1 is a partial closeup view of an embodiment illustrating the most complex version of the present invention applied for a regular grid of city streets shown in FIG. 2. This embodiment is designed for two way traffic having four lanes in each direction; two of the lanes are nonstop lanes in this embodiment. When fastroad is first introduced, it may be advantageous to designate only one lane (L2) as a nonstop lane. This arrangement offers an easy escape for those who need time to get used to the new rules.

An east-west oriented two way fastroad 1A is shown having four lanes L1 to L4 in each direction, separated by center divider 2. In an arbitrarily selected point in time, several vehicles 3 travel westward on nonstop lanes L2, L3. On both end of the two blocks of fastroad 1A shown, two north-south fastroads 4B, 4C intersect fastroad 1A. These north-south fastroads are similar both in style and equipment to the east-west fastroads, building up a homogenous two way fast grid in the region. A two lane side street 5 is joining at midway between nonstop intersections 1A-4B and 1A-4C.

Along the fastroads (e.g., 1A, 4B, 4C) of the grid, a string of overhead traffic light fixtures 6 is accommodated with even spacing for each travelling direction of the fastroad. Each of these fixtures emits control signals in narrow beams directed toward the approaching vehicles. The distance between the fixtures is small enough to allow the viewing at least one fixture in the string by each driver. In the present embodiment, the number of fixtures between subsequent nonstop intersections is six; (the minimum is one at each street corner; in the simplest low cost version, no additional lights are needed).

Along the fastroads (e.g., 1A, 4B, 4C) sensors are also placed for generating input signals regarding the traffic and road surface conditions. In the presently described embodiment, these sensors are housed in the same fixtures 6. (In low cost versions, sensors can be omitted.)

A central control device 7, (known in the art) controls the entire system; it is connected to each fixture 6 by a network capable of carrying both the control signals and the input signals generated by the sensors. Each sensor is capable of generating input signal for central control device 7 when triggered by a passing vehicle. In the present embodiment, each fixture is equipped with a local electro-mechanical control device (73 in FIG. 7, 8, described in detail in connection with FIG. 12 and 13). A block diagram showing the interconnections between central control device 7 and these local control devices is described in connection with FIG. 7.

Central control device 7 sends pulses with preselected frequency for generating the signal progression along the roads throughout the grid. This frequency is adjustable manually, and automatically by sensors for adapting the system speed to different environmental and traffic flow conditions.

Local control device (73 in FIGS. 7 and 8) is accommodated in each light fixture (described in detail in connection with FIGS. 12 and 13). A starting position is assigned to each fixture 6 according to the sequence requirements of the signal progression. Receiving the pulses generated by central control device 7, each local control device responds to each pulse with a forward step. The signal progression system requires that the lights arranged in three zones, each zone containing a predetermined number of lights. These three zones are moving, like waves, and they are laid out along the road in repeated sequences, moving (jumping) from one fixture to the next. There is no mechanical movement in these waves: only the switching of the border lights to different color one by one creates the illusion that the zones are moving.

This operation requires that each local control device in each fixture perform a step by step switching operation in unison. Each starting from its starting position, switches on the signal which was emitted by the previous fixture in the previous cycle. Several fixtures 6 in succession emits the same zone marker signals along the fastroad. The three zones follow one another in the same manner repeatedly. In the first zone, the "vacate zone", the emitted zone marker signals are red, in the following "transition zone" they are yellow, and in the third, the "travel zone", they are green. In the nonstop lanes, vehicles are admitted and permanently authorized to travel only in the travel zones of the nonstop lanes; they are temporarily admitted in transition zones. Vehicles in vacate zones are not admitted in the nonstop lane: if they drifted into it, they are obliged to leave the lane immediately. They either exit into the curb lane, or leave the fastroad.

In a centrally controlled grid of fastroads the goal is to secure the nonstop passage of each platoon without stopping. This can be achieved by accommodating the same number of signal emitting fixtures in every fastblock enabling the passing of every travel zone through every intersection through a vacate zone of the cross traffic. Adequate transition zones are provided for safety.

Referring to FIG. 1, where wide divided road is shown, lane L1 is assigned to left turning vehicles 8. Lanes L2 and L3 are the nonstop lanes. Right lane L4 is reserved for entering, exiting, and right turning vehicles 9 and 10, and vehicles 11 making an U-turn. Vehicle 14 driving straight on lane L4 must yield the right of way for all vehicles turning or crossing on path 11 or 13.

Figure 10:
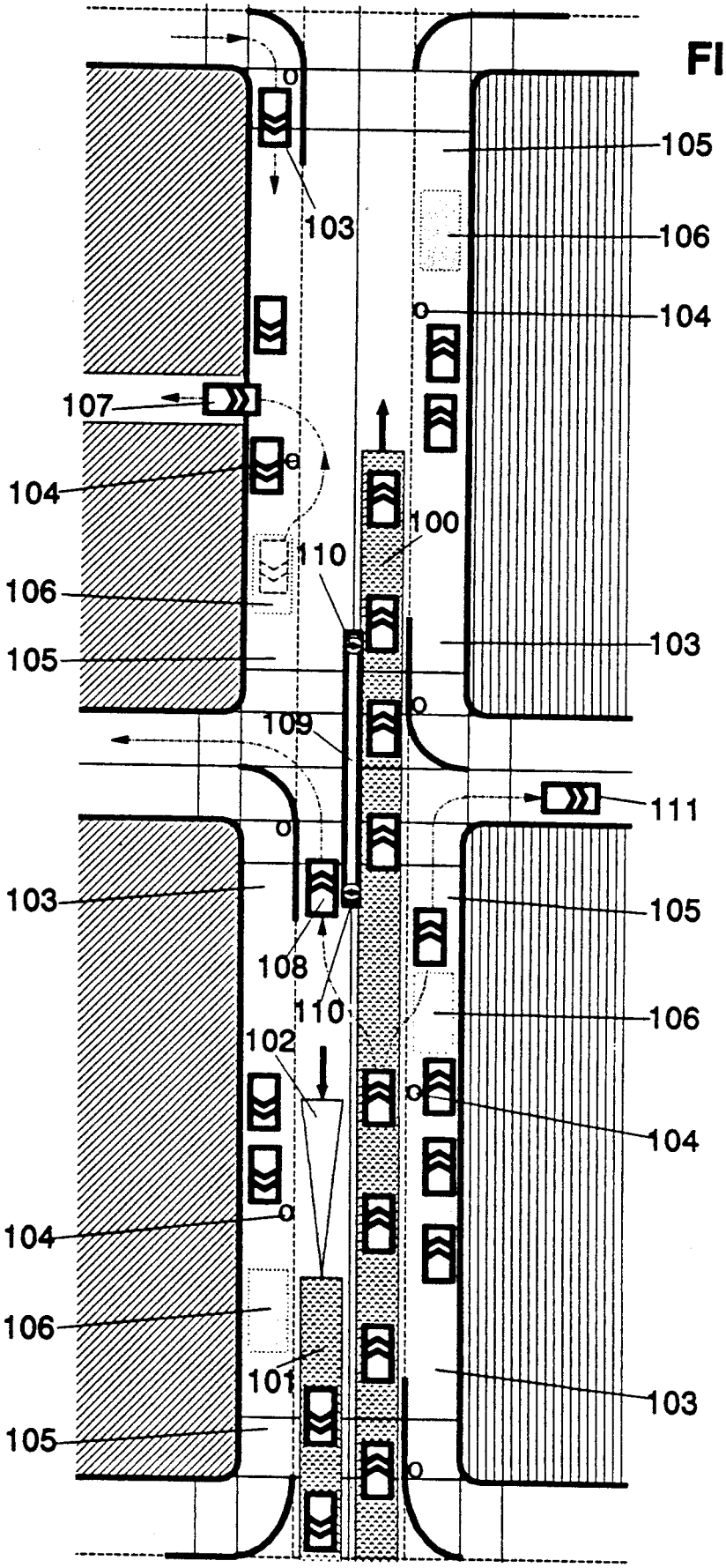
FIG. 10 shows the plan view of a narrow two way fastroad illustrating parallel parking, and the use of temporary left turn lane.
Figure 11:
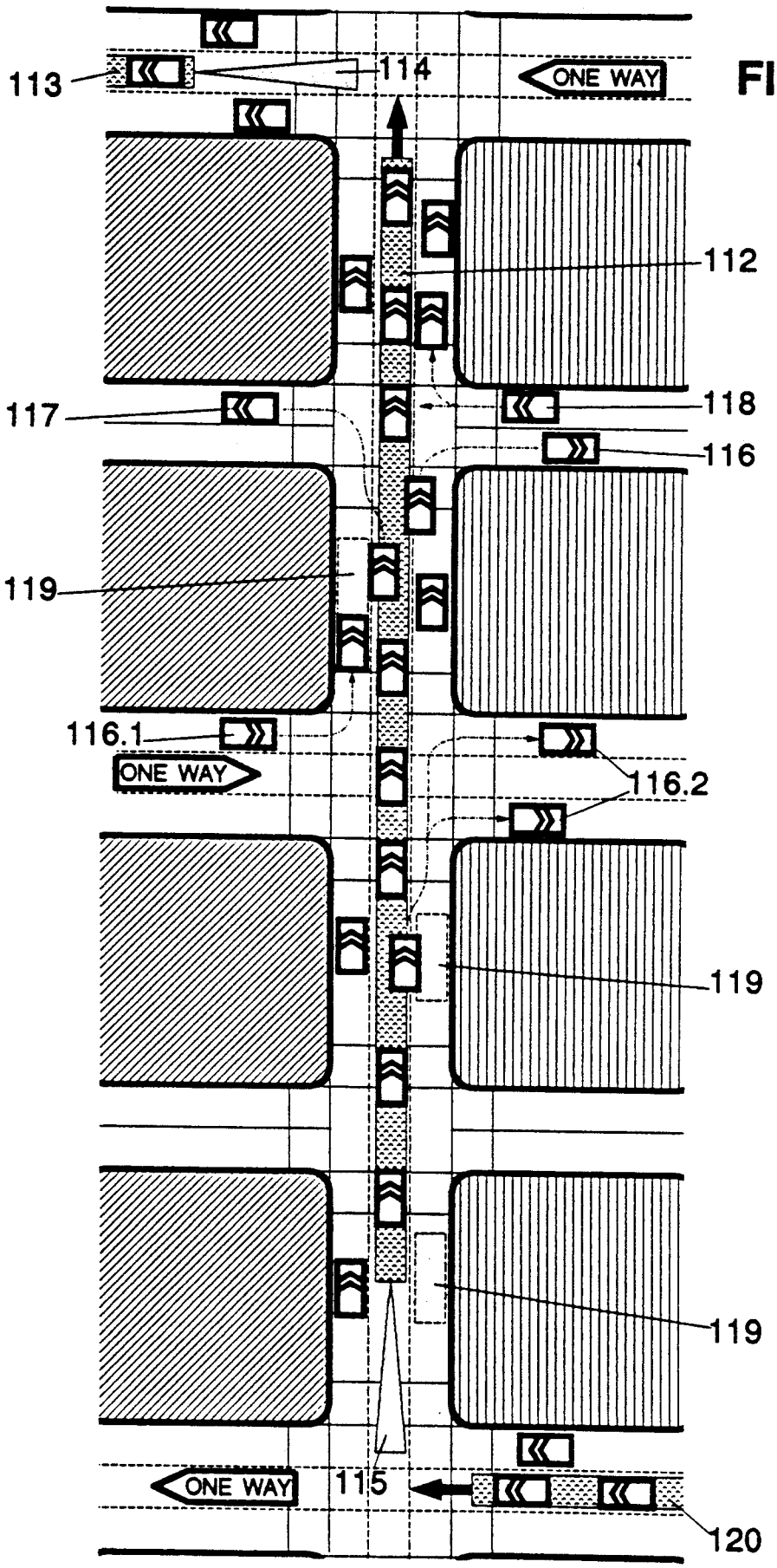
FIG. 11 shows the plan view of a narrow one way fastroad illustrating parallel parking, and right and left turns.

On city streets, where parking and loading space cannot be eliminated in the blocks, space can be designated for these purposes in the middle section of the blocks (as shown in FIGS. 10 and 11).

FIG. 2 illustrates the layout pattern of the three zones for the nonstop traffic flow on fastroads in a two way grid of city streets in the same selected point in time. East-west fastroads 1A, 1B, 1C, 1D, 1E intersect north-south fastroads 4A, 4B, 4C, 4D. Each zone is represented on each fastroad by identical symbols described in detail with reference numbers in connection with intersection 1C-4B. The travel zone (where the emitted light signal is green) for northbound traffic on fastroad 4B is represented by frame 21B, the transition (yellow) zone for the same by triangle 22B. The orientation of the triangles as arrows indicate the direction of the movement of the zones. Travel zone 23A is for the southbound traffic, with transition zone 24A. On fastroad 1C, eastbound travel zone 25B with its transition 26B and westbound travel zone 27B with its transition zone 28B illustrate the momentary situation at intersection 1C-4B. On FIG. 2, additional travel and transition zone pairs are illustrated in two block intervals preceding or following the zones referenced above. (E.g., zone 21A precedes zone 21B, which in turn followed by zone 21C, zone 23B is following zone 23A, etc.) In the gap (e.g., 211) between the marked zone pairs, the vacate zones are accommodated where the emitted first set of zone marker light signal is red, and no vehicle is allowed on the nonstop lanes. On the opposite side of the block northeast from intersection 1C-4B, two additional travel zones 29,212 join to zones 21B, 27B, forming a square loop having clockwise orientation.

To avoid the crowding of the drawing, the string of signal emitting fixtures 6 are shown only on the eastbound side of fastroad 1C. Here four emitter fixtures 6A, 6B, 6C, 6D of the string placed in the travel zone 25B emitting green light at the moment. Transition zone 26B contains two fixtures 6E, 6F emitting yellow light. The next eight fixtures in front of the yellow lights emit red light indicating the zone to be vacated. Preceding the (red) vacate zone, starting with the next (green) travel zone 25A marked by fixtures 6H, 6I, 6J, 6K, the whole zone sequence is repeated along the fastroad as many times as needed for covering the entire grid under central control. On the opposite side of the fastroad, the arrangement is the same, except the direction of the movement of the zones is opposite.

It can be seen from FIG. 2, that the length of the travel zone plus the transition zone is equal to the length of the fastblock between two successive nonstop intersections. The minimum length of the transition zone is equal to the safe braking distance at the operating velocity at the existing road conditions. This length is adjustable by central control device 7 to accommodate the factors influencing the braking distance (system speed, icy road, etc.). The length of the vacate zone (e.g., 211 on fastroad 4B) is equal to the length of the same fastblock plus the sum of the width of the two crossing fastroads enclosing the block.

The starting position of the zones in a selected point in time, as illustrated in FIG. 2, form a square (e.g., 21B, 29, 212, 27B) having clockwise orientation in their loop in right hand driving traffic systems. These squares are alternating in a checkerboard pattern in the grid under central control. The closed square loops enclose blocks having diagonal hatching, as shown in FIG. 2.

If the blocks are short, the vehicle carrying capacity of the fastroad can be increased by arranging fastroads in a grid with several block intervals allowing a larger number of vehicles in each platoon. In this arrangement, the travel zones grow relatively larger, since the transition zones and street widths remain the same, while the platoons are longer.

Central control device 7 is operated to send the pulses to each local control device of each emitter fixture 6. Receiving their messages, each fixture 6 is induced to perform simultaneous recurrent switching operations along the fastroads. This switching produces the simultaneous apparent movement of all zone markers in increments.

In a grid with no irregular blocks, the distance between subsequent fixtures is constant. On the basis of this value and the value of the desired nominal average speed of the movement of the zones, the nominal switching frequency for central control device 7 can be determined. There is provision for selecting this frequency manually, and modifying it on the basis of the input from sensors. The result is the system speed maintained by central control device 7 throughout the area under central control for a grid where every block has the same length. In practical applications this hardly ever happens. The pulse frequency remains the same throughout the irregular grid: thus the speed varies proportionally to the length of the blocks. This is the way for providing local adjustment of the nonstop speed in selected portions of a grid of roads by proportionally varying the distance between signal emitting fixtures at selected portions.

Each block has its different nonstop speed. For accommodating safety requirements in some cases, it is useful to vary the nonstop speed even in shorter portions of the road, e.g., within a block for allowing more time for large number of left turning vehicles in two way traffic.

The switching is initiated by central control device 7 by individually addressing each fixture with a pulse in every cycle prompting each to emit the signal emitted in the previous cycle by the fixture behind it. These recurrent simultaneous sequential switching operations result in the apparent movement of the emitted zone marker signal without any mechanical movement. All zones moving in increments with centrally controlled apparent average velocity variable along each said road under central control. This velocity represents the nonstop speed for the given portion of the road. After each switching, during the new cycle, each signal is emitted by the next fixture in the sequence: every signal jumps from one fixture to the next in the string. Consequently, as the drivers drive along the fastroad, the string of the green travel zone marker signals jump from one fixture to next fixture along the road with the system speed on the average, moving like a green train. The main task of the drivers is to keep up with it, while maintaining minimum safe distance from the preceding vehicle.

The average velocity of the movement of the zones depends only on the frequency of the switching and the distance between fixtures. In the present embodiment, sensors along fastroads report changes in environmental and traffic conditions prompting the central control device for surveying the traffic congestion, weather and road surface conditions in the grid and for controlling the system speed by adjusting the frequency of the switching operations for establishing and maintaining the optimum safe velocity for the controlled roads under the prevailing driving conditions. Thus the system operate safely and most advantageously.

In order to accommodate the largest number of vehicles in a platoon within the travel zone under peak traffic conditions, the first driver in the platoon moves up to the border of the zone. The others follow keeping the minimum safe clearance between vehicles. The zone end marker feature provides a special alert to the drivers that they are close to the end of the green zone.

Those drivers who find themselves in the vacate (red) zone must immediately vacate the nonstop lanes of the zone by accelerating into the (green) travel zone before reaching an intersection. If that is not possible, they must move into the right lane (L4) and wait there until the next green zone comes along, and they can merge into it where space is available toward the end. Buses and emergency vehicles are allowed to merge into the yellow zone in the front of the green zone. No vehicles is authorized to stay in the nonstop lanes of the red (vacate) zone waiting, or driving into an intersection. This procedure is equivalent to driving into the red light.

If the grid is uneven in some part of the system, a simple way to compensate for this problem is using the same number of signal emitter fixtures between intersections with greater or smaller intervals, in order to maintain the synchronous movement of the zones. Nonetheless, drastic local reduction of the distance between fixtures and intersections should be avoided, because the platoon of vehicles in the green zone has a minimum length.

There is no way to make a left turn directly into an intersecting fastroad in the two way traffic arrangement. It is practical, however, on divided roads (e.g., 1A in FIG. 1) to provide a designated opening for performing nonstop left turn and U-turn at substantially midway between two subsequent nonstop intersections while the vacate zone is passing through in the opposing traffic at the given point. Travelling on a fastroad, nonstop left turn can be performed through this opening in divider 2 close to midway between two intersections of two way fastroads. First, an U-turn is to be performed. The U-turn can be either narrow along the path of vehicle 11 into the curb lane, followed by a right turn into fastroad 4C on path 12, or wide on path 13 around a block, followed by a right turn along path 13 from a side street. The turning can be completed in both cases without waiting or stopping; several vehicles can do it from one green zone, since the opposite green zone is more than a block away when the left turn can be started into the empty vacate zone of the opposing traffic. Thus the nonstop character of the system is preserved even in left turns or U-turns, speeding up this move that is, in case of conventional control of heavy traffic, the most time consuming, and, often not even permissible.

The crossing of two way fastroads from side streets is not possible, nor a left turn, only right turn. Coming from a side street (e.g., 5), all vehicles must turn right without stopping; they must yield for U-turning vehicles (on path 11), and for vehicles 10 exiting the nonstop lanes. Any straight traffic 14 on the right lane of fastroads must yield to all vehicles. The right lane (L4) might be blocked briefly under peak traffic conditions by vehicles waiting for the next green zone.

Vehicles entering into the fastroad use the right lane as an on ramp. In two way traffic system, all entries are made by turning right into the fastroad. Vehicles entering while a vacate (red) zone is passing through wait on the right lane for the next green zone, then accelerate, and merge into the nonstop lanes, if space is available. At entry streets with large number of entering and U-turning vehicles, adding a block long extra right lane is justifiable to separate the right turning vehicles from the entering vehicles. Thus the turning can go on unhindered by vehicles waiting for the arrival of the next green zone.

On sections with infrequent entering and turning, the vehicles in the empty right lane can travel with the velocity of the system. The only risk involved is the occasional stop when turning and entering vehicles pile up ahead, and the green zone proceeds while the slowed down vehicles on the right lane are overtaken by the approaching red zone. They must wait there for the next green zone, and when it arrives merge into the nonstop lanes, if space is available, or continue in the right lane if it started moving.

If a disoriented driver keeps proceeding in the red (vacate) zone, at the next intersection stops at the red light, turning the fastroad into a conventional stop-and-go system. When the platoon in the next green zone arrives, it has to stop behind him. If he slowly starts up and most of the green zone runs ahead of him empty, the tail end of the platoon gets squeezed out at the end, and have to leave the nonstop lane, and wait for the next green zone. If a disabled vehicle remains stranded on the nonstop lane, the traffic flow stops if there is no way to get around it on the curb lane. If sensors are in the system, adequate danger signals (e.g., flashing red lights) can be applied, until the disrupting vehicle can be cleared up from the nonstop lanes.

To ascertain that nonstop traffic is possible in any given grid configuration, it is sufficient to move each zone pair from a planned starting configuration (e.g., FIG. 2) ahead step by step, using the same number of steps in each block, until the image returns to the starting configuration. The length of the steps may have to vary in accordance with the length of the blocks. Using this simple procedure, it can be demonstrated that the arrows, representing the (green) travel zones with their (yellow) triangular tips for safe transition, never interfere with one another, consequently the system provides unhindered crossing of every intersection in the entire grid under central control, with safe clearance for all the vehicles travelling nonstop in the (green) travel zones.

Figure 3:
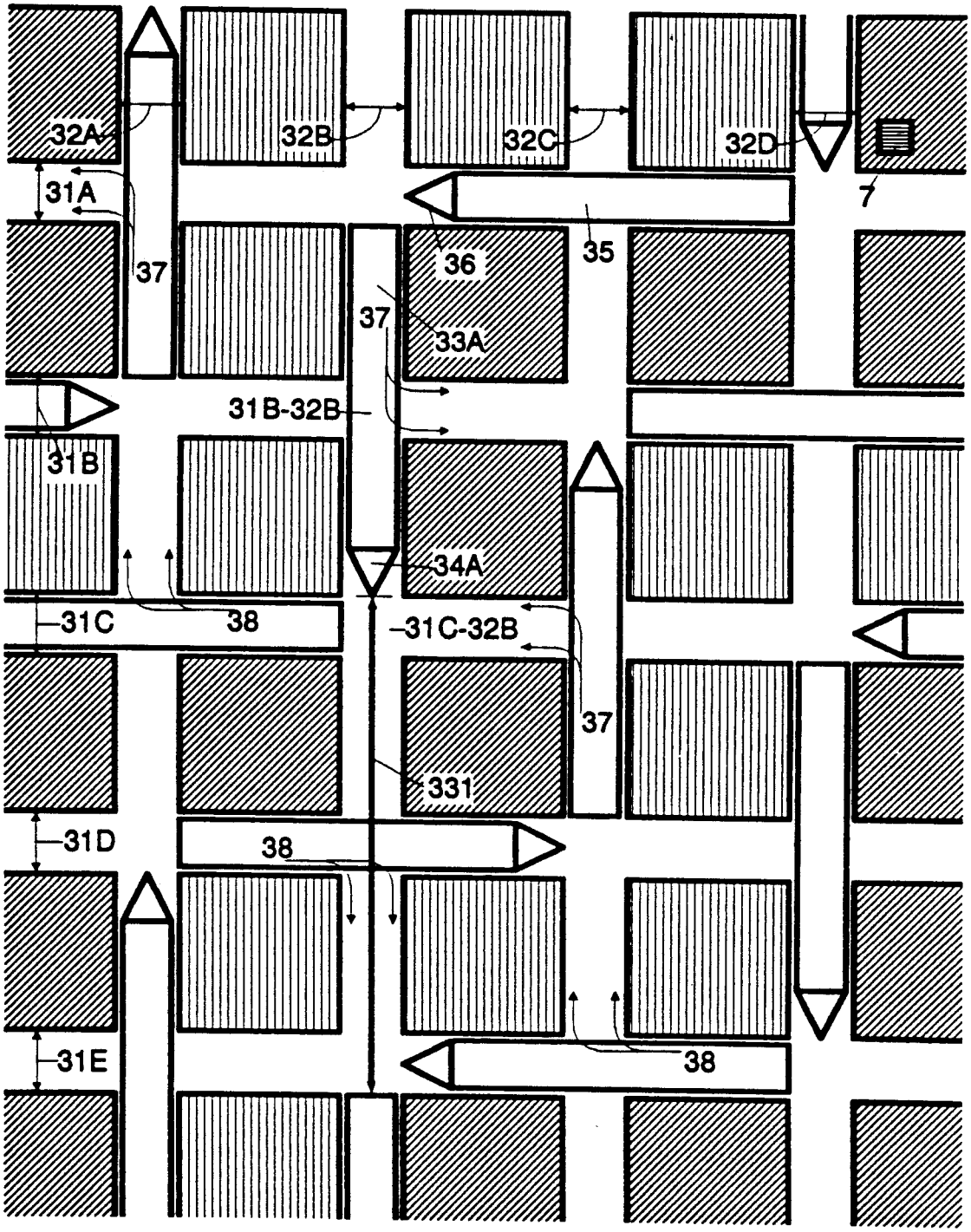
FIG. 3 shows the plan view of a grid of one way fastroads with the arrangement of zones.

FIG. 3 illustrates part of a grid under central control having one way fastroads: 31A, 31C, 31E westbound, 31B, 31D eastbound, 32A, 32C northbound, 32B, 32D southbound. The length of (green) travel zone 33A on southbound fastroad 32B is more than twice as long as in the two way arrangement: its length plus the length of the (yellow) transition zone 34A is equal to the sum of the length of two fastblocks between two subsequent nonstop intersections plus the width of the crossing fastroad separating the two fastblocks, and the length of the vacate zone (e.g., 331) is substantially equal to the sum of the length of the two fastblocks between two subsequent nonstop intersections plus the width of the crossing fastroad separating the two fastblocks, plus the sum of the width of the two crossing fastroads enclosing the two fastblocks. The minimum length of the transition zone is equal to the safe braking distance at the operating velocity at the existing road conditions. The length of the zones on an east-west fastroad is the same. Sample paths for left turns 37, and for right turns 38 are illustrated in FIG. 3.

The hardware of the control system, the central control device (7), and the local control units (73) remain the same as described in connection with FIGS. 1, 2, 7, 8, 12, and 13. In an arbitrarily selected point in time, as illustrated in FIG. 3, green zones in the grid of one way fastroads line up to form two alternating zigzag patterns in the grid leaning diagonally in southwest-northeast direction. The first pattern has southwest orientation, the second one has northeast orientation. The first pattern contains the combination of southbound and westbound green zones, the second one northbound and eastbound green zones, as shown in FIG. 3.

The method of moving the zones in one way regions is the same as in the two way fastroad region described in connection with FIG. 1 and 2.

In the one way version shown in FIG. 3, entering, exiting, and turning both left and right (paths 37 and 38) is possible without stopping from the closer curb lane into both curb lanes of crossing fastroads, or into side streets, where the orientation of the one way traffic permits it. After making a turn into an intersecting one way fastroad, the vehicle must wait in one of the curb lanes until the green zone comes along, and, after acceleration, merging is feasible into the nonstop lanes, if space is available.

Crossing the fastroad from a side street between one way fastroad intersections is easily feasible; most of the time period while the red zone moves through the location is available for crossing without stopping. If synchronized conventional traffic lights are provided, it is the most practical to control them to produce half velocity green wave in side streets, capable of carrying nonstop overflow traffic slower, but with adequate safety. Here, however, the flow is exposed to frequent interruptions by local stopping and parking, and it cannot be expected to keep up with the green wave all the time.

The one way arrangement uses the available road space more efficiently. For example, if a two way divided fastroad with four lanes in each direction (e.g., 1A in FIG. 1) will be converted into one way traffic, it offers about twice as much usable space for the accommodation of the traffic in the nonstop lanes. In addition, it offers possibility for easy left and right turns, and easy crossing and half velocity green wave on side streets.

Figure 4:
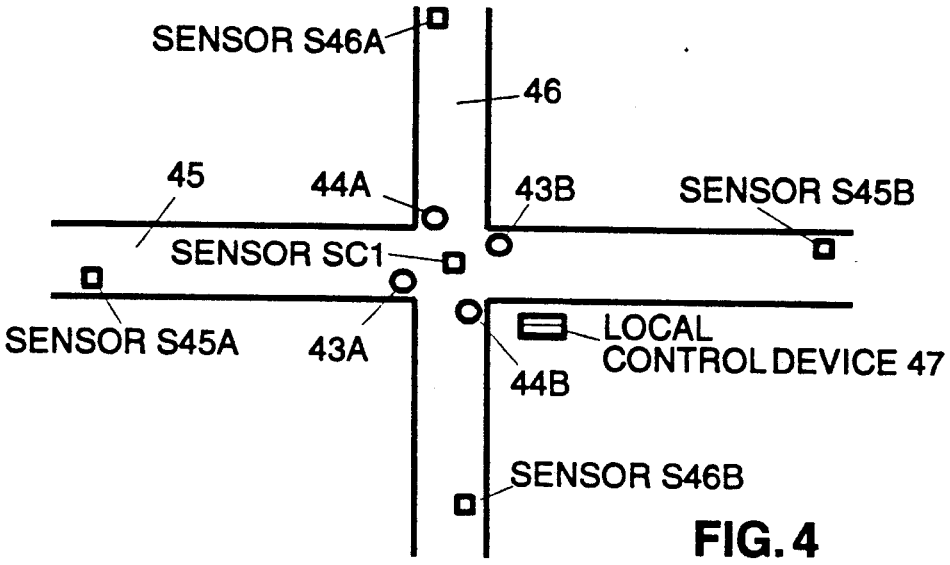
FIG. 4 shows the plan view of an intersection of two roads equipped with local traffic control with reduced stopping.

In FIG. 4, a version of the nonstop system for light two way traffic with local control of an intersection is illustrated. This version is applicable for a region of city streets or on a highway having light cross traffic, controlled by stop signs in most conventional arrangements. In this version of the nonstop system according to the invention, stop signs may be combined with locally controlled automated traffic lights to take over in case of a breakdown of the system.

The light traffic control system has a local control device for controlling traffic at a crossing of a first street and a second street. There are signal lights arranged at the crossing, facing each approach, adapted for emitting alternately red, green, and yellow light. They are controlled by the local control device responding to sensor input. First, second, and third sensors adapted for sending input signal to the control device when triggered by a passing vehicle, the first sensors being accommodated on the first street, second sensors on the second street, one on each approach along the streets before the crossing at a minimum distance equal to the safe braking distance at the prevailing maximum velocity of the vehicles on each street. The third sensor is accommodated at the crossing, and it works with vehicles travelling in either direction.

The first sensor is adapted to send input to the control device when triggered by a passing first vehicle on the first street prompting the control device to switch the lights to green for the first street. An interlock circuit is adapted to be activated by the first sensor to prevent a change in the signal light output until the third sensor at the crossing is triggered by the passing of the first vehicle through the crossing releasing the interlock circuit. The second sensor is adapted to send input to the control device when triggered by a passing second vehicle on the second street prompting it for switching the lights to green for the second street. The interlock circuit is adapted to be activated by the second sensor to prevent a change in the signal light output until the third sensor at the crossing being triggered by the passing of the second vehicle through the crossing releasing the interlock circuit.

A timer switch is in the circuit adapted to start its operating period after each switching of the orientation of the traffic lights and to end its operating period releasing the interlock circuit after the preset time delay (0.5 to 2 minute) elapsed.

It can be seen in FIG. 4 in details that an east-west street 45 and a north south street 46 meet in an intersection. Two conventional traffic lights 43A, 43B, control the traffic on east-west street 45 at the intersection. The two traffic lights 44A, 44B on north-south street 46 are combined with conventional stop signs for safety reason in case of system failure. Two first sensors S45A, S45B are accommodated in the approaches of the intersection on the east-west street, and two second sensors S46A, S46B on the north-south street, in a distance about twice the safe braking distance. Third sensor SC1 is placed at the center of the intersection. When triggered by a vehicle, these sensors send input signals through communication channels to a local control device 47 that operates the system.

Figure 5:
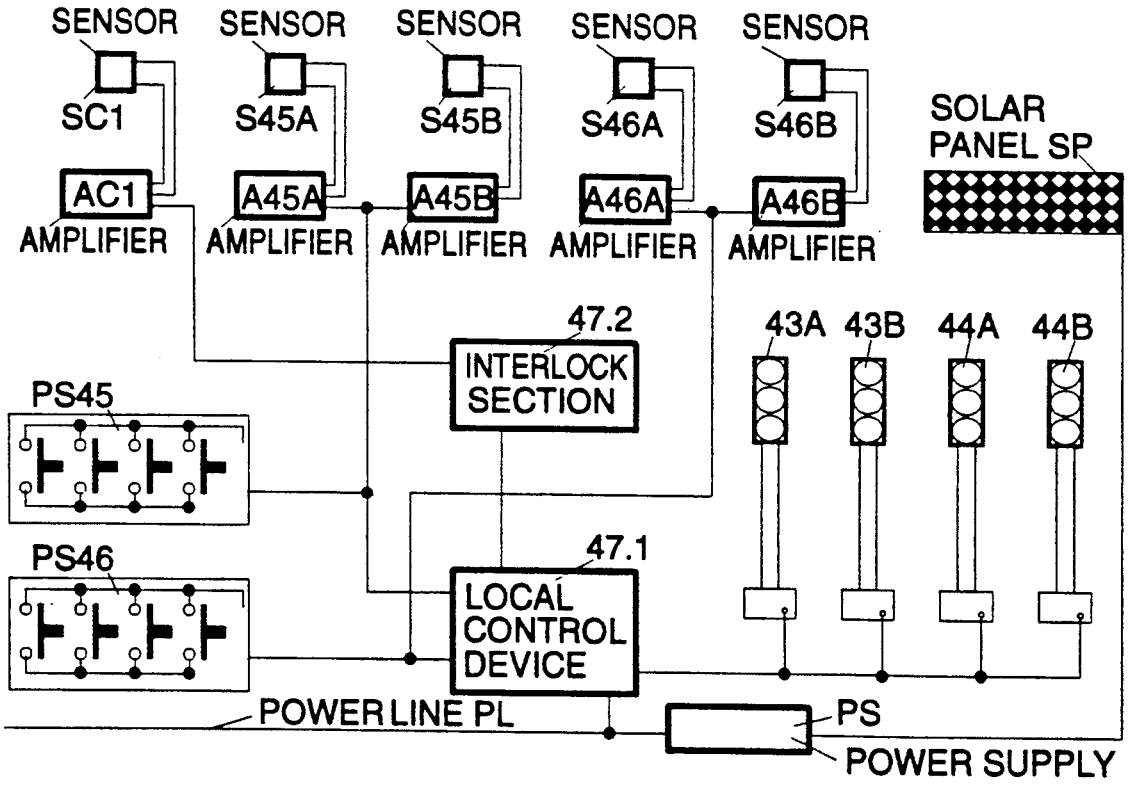
FIG. 5 shows the block diagram for FIG. 4.

In FIG. 5, a block diagram of the interconnections of the system is shown. Sensors S45A, S45B, S46A, S46B are connected to local control device 47.1 via their respective amplifiers A45A, A45B, A46A, A46B. Central sensor SC1 is connected to the interlock section 47.2 of control device 47 via amplifier AC1. Two groups of four push button switches PS45, PS46 are also in the input line to control device 47.1. Power line PL supplies power to the system, if it is available. In remote places, without power, battery based power supply PS is provided with solar panel (SP) recharger.

Figure 6:
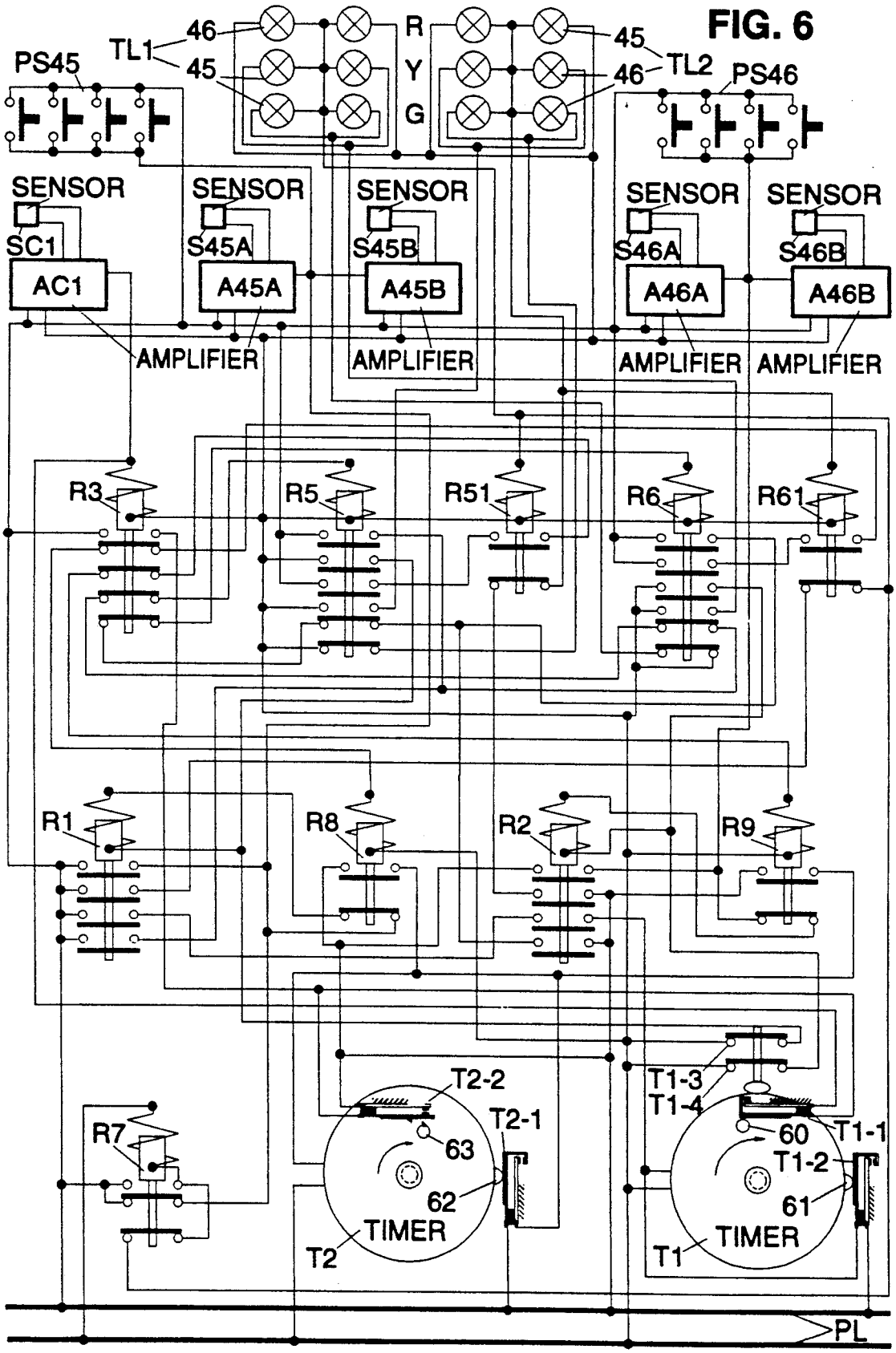
FIG. 6 shows the schematic diagram of the control system of FIGS. 4 and 5.

The schematic diagram of an electro-mechanical version of control device 47 is presented in FIG. 6. It contains ten relays and two rotary timer switches.

When the power is switched on, local control device 47 sets lights 43A, 43B to green on east-west street 45, and lights 44A, 44B to red on north-south street 46, until a second vehicle is approaching the intersection on street 46, and triggers one of second sensors S46A or S46B sending input to control device 47. If no traffic approaches on the east-west street, control device 47 instantly switches traffic lights 44A, 44B to green, and 43A, 43B to yellow, then to red. Thus the approaching vehicle on street 46 can cross or turn without stopping and waiting. Unnecessary stops are avoided. At the same time an interlock circuit is activated in control device 47 which is released when the vehicle passes the intersection triggering SC1 sensor, or timer switch T2 interrupts the interlock when a preset time elapsed. The release leaves the system open for sensor or push button input from the cross street. The traffic lights remain unchanged until this input occurs.

In this control arrangement, light traffic on both streets remains uninterrupted most of the time. Locally placed inexpensive control device can handle the four lights, using the input of the five sensors at each intersection. In remote settings, where no electric power line (PL) connection is available, battery based power supply (PS) operated system can be used with local solar panel (SP) recharger.

The combination of conventional stop signs with traffic lights 44A, 44B serves the purpose of collision prevention in case of the breakdown of the local control system.

In FIG. 6, the complete schematic diagram of local control device 47 is presented. It contains the same sensors, amplifiers and push button switches listed in connection with FIG. 5. It contains furthermore ten relays numbered R1 to R9 (no R7), and R51, R52. Two rotary timer switches are also in the system, T1, T2. All relay contacts are referenced by the reference of the relay, and their position, starting the numbers from the top. (E.g., R5-4 means the fourth contact from the top of relay R5.) Both timers operate leaf switches by cam discs: timer T1 has T1-1 leaf switch, operated by pin 60, and T1-2 leaf switch, and T1-3, T1-4 sliding contacts operated by cam 61. Timer T2 operates leaf switch T2-1 by cam 62, and leaf switch T2-2 by pin 63. Timer T1 turns around once in 3 seconds then stops. Timer T2 running time is adjustable between 20 seconds and 2 minutes.

The operation of local control device 47 is described in details in the following. The description includes five distinct phases of the operations.

1. Initial power up designed to turn on the first set of traffic lights TL1 (green in 45 direction):

| | |
|---|---|
| Power switched on: | R7-2 (normally closed) bypasses open R1-2 contact energizing R1 relay; |
| R1 contacts switch: | R1-1 closes locking up R1 relay via closed contacts R8-2, T1-3; |
| | R1-2 switches on the first set of traffic light circuits TL1, green in 45, red in 46 direction, and energizes R7 and R51 relays via closed contact R61-2; |
| | R1-3 closes in open T1 timer circuit (R2-3 remains open); |
| | R1-4 energizes R5 relay via closed contacts R6-5, R3-3; |
| R51 contacts switch: | R51-1 closes in R9 relay's circuit (R5-3 also closes); |
| | R51-2 opens in the open second set of traffic light circuits TL2, green in 46, red in 45 direction (R2-2 open); |
| R5 contacts switch: | R5-1 closes locking up R5 relay; |
| | R5-2 closes bypassing T1-3 timer contacts in R1 relay's circuit; |
| | R5-3 closes (R51-1 closed) energizing R9 relay; |
| | R5-5 opens in R6 relay's open circuit (R2-4, R6-1 remain open); |
| | R5-6 opens in the open green branch of the second set of traffic lights TL2, green in 46 direction (R51-2 remains open); |
| | R5-4 closes switching over the open second set of traffic lights TL2 to yellow in 46 direction; (the lights remain off); |
| R7 contacts switch: | R7-1 closes locking up R7 relay; |
| | R7-2 opens removing the bypass from R1-1 contact; |
| | R7-3 opens disconnecting R7 relay from the first set of traffic lights TL1 (green in 45 direction); |
| R9 contact switches: | R9-1 closes energizing T2 timer switch; |
| | R9-2 opens in R2 relay's open circuit (R2 not energized; R2-1 open) preventing the premature switching of the traffic lights. |

2. Removing the interlock for preventing the switching of the first set of signal lights.

Two versions:
(a) A vehicle passes the crossing triggering sensor SC1.
(b) A specified time elapsed since the last switching of the traffic lights.
(a) Sensor SC1 sends a signal to amplifier AC1 which generates a pulse applied to R3 relay,
(b) T2 timer switch closing T2-2 contact for 0.2 second after the specified time elapsed; (adjustable from 20 seconds up to 2 minutes);

| | |
|---|---|
| (a) Pulse output | R3 relay is energized, or |
| (b) T2 switches: | T2-2 closes briefly energizing R3 relay after the pre-set time elapsed; |
| | T2-1 open de-energizing the stopping T2 timer switch 2 second later in starting position; |
| for both (a) and (b): | |
| R3 contacts switch: | R3-1 closes locking up R3 relay; |
| | R3-2 opens in R8 relay's open circuit (R6-2, R61-1 remain open); |
| | R3-3 opens de-energizing R9 relay; |
| | R3-4 opens de-energizing R5 relay; |
| | R3-5 opens in R6 relay's open circuit (R2-4, R6-1 remain open); |
| R5 contacts switch back into de-energized positions: | R5-1 opens removing the lock on R5 relay; |
| | R5-2 opens removing the bypass on T1-3 timer contacts in R1 relay's circuit; |
| | R5-3 opens in R9 relay's open circuit (R3-3 remain open); |
| | R5-5 closes in R6 relay's open circuit (R2-4, R3-5, R6-1 remain open); |

-continued

| | |
|---|---|
| | R5-6 closes (in the open green light circuits TL2 in 46 direction); |
| | R5-4 opens, switching back from yellow to green light in 46 light's circuit; |
| R9 contacts switch: | R9-1 opens removing the bypass in T2 timer circuit before T2 stops; |
| | R9-2 closes in R2 relay's open circuit removing the interlock; |
| | (R2-1 remains open). |

3. A pedestrian or a vehicle approaches in 46 direction triggering S46A or S46B sensor:

R2 relay is energized by a pedestrian operating a push-button switch in the PS46 group, or by a pulse generated by amplifier A46A or A46B.

| | |
|---|---|
| R2 contacts switch: | R2-1 closes locking up R2 relay; |
| | R2-2 closes in open second set of traffic light circuits TL2, green in 46, red in 45 direction (R51-2 remains open). |
| | R2-3 closes in the T1 timer circuit starting up T1 timer switch; |
| | R2-4 closes in R6 relay's open circuit (R3-5 remains open); |
| T1 contact switches: | T1-1 opens briefly after 0.2 second deenergizing R3 relay; |
| R3 contacts switch: | R3-1 opens removing the lock from R3 relay; |
| | R3-2 closes in R8 relay's open circuit (R6-2, R61-1 remain open); |
| | R3-3 closes in R9 relay's open circuit (R5-3 remain open, R51-1 closed); |
| | R3-4 closes in R5 relay's circuit (R6-5 opens, R5-1 remain open, R1-4 closed); |
| | R3-5 closes energizing R6 relay via R2-4, R5-5; |
| R6 contacts switch: | R6-1 closes locking up R6 relay; |
| | R6-2 closes in R8 relay's open circuit (R61-1 open); |
| | R6-3 closes bypassing T1-4 timer contacts in R2 relay's circuit; |
| | R6-5 opens in R5 relay's circuit to keep it open (R1-4, R3-4 closed); |
| | R6-6 opens, (in the green light circuits TL1 in 45 direction); |
| | R6-4 closes switching over from green to yellow light in TL1 circuit in 45 direction; |
| T1 contacts switch: | T1-3 opens briefly after 3 seconds de-energizing R1 relay; |
| | T1-4 opens briefly after 3 seconds with no effect (bypassed by R6-3); |
| | T1-2 opens after 4 second running time de-energizing T1 timer switch stopping it in starting position; |
| R1 contacts switch back into de-energized positions after 3 seconds: | R1-1 opens removing the lock from R1 relay; |
| | R1-2 switches off the first set of traffic light cirucits TL1, green in 45, red in 46 direction; and de-energizes R51 relay; |
| | R1-3 opens in open T1 timer circuit before T1 stops; |
| | R1-4 opens in R5 relay's open circuit (R6-5, R5-1 remain open); |
| R51 contacts switch: | R51-1 opens in R9 relay's open circuit (R5-3 remains open); |
| | R51-2 switches on the second set of traffic light circuits TL2, green in 46, red in 45 direction, and energizes R61 relay. |
| R61 contacts switch: | R61-2 opens in the already interrupted first set of traffic light circuits TL1, green in 45 direction; |
| | R61-1 closes energizing R8 relay via R6-2; |
| R8 contact switches: | R8-1 closes starting up T2 timer switch; |
| | R8-2 opens and interrupts the open R1 circuit preventing the premature switching of the traffic lights. |

4. Removing the interlock for preventing the switching of the second set of signal lights TL2.

Two versions:
(a) A vehicle passes the crossing triggering sensor SC1.
(b) A specified time elapsed since the last switching of the traffic lights.
(a) Sensor SC1 sends a signal to amplifier AC1 which generates a pulse applied to R3 relay,
(b) T2 timer switchclosing T2-2 contact for 0.2 second after the specified time elapsed (adjustable from 20 seconds up to 2 minutes);

| | |
|---|---|
| (a) Pulse output | R3 relay is energize, or |
| (b) T2 switches: | T2-2 closes briefly energizing R3 relay after the pre-set time elapsed; |
| | T2-1 opens de-energizing and stopping T2 timer switch 1 second later in starting position; |
| for both (a) and (b): | |
| R3 contacts switch: | R3-1 closes locking up R3 relay; |
| | R3-2 opens de-energizing R8 relay |
| | R3-3 opens in R9 relay's open circuit (R5-3, R51-1 remain open); |
| | R3-4 opens in R5 relay's open circuit (R1-4, R5-1 remain open). |
| | R3-5 opens de-energizing R6 relay; |
| R6 contacts switch back into de-energized positions: | R6-1 opens removing the lock on R6 relay; |
| | R6-2 opens in R8 relay's open circuit (R3-2 remains open); |
| | R6-3 opens removing the bypass on T1-4 timer contacts in R2 relay's circuit; |
| | R6-5 closes in R5 relay's open circuit (R1-4, R3-4, R5-1 remain open); |
| | R6-6 closes (in the open green light circuits in 45 direction); |
| | R6-4 opens, switching back from yellow to green light in the first set of traffic lights circuit TL1; |
| R8 contacts switch: | R8-1 opens removing the bypass in T2 timer circuit before T2 stops; |
| | R8-2 closes in R1 relay's open circuit removing the interlock; |
| | (R1-1 remains open). |

5. A pedestrian or a vehicle approaches in 45 direction triggering SS45A or SS45B sensor:

R1 relay is energized by a pedestrian operating a push-button switch in the PS45 group, or a pulse generated by amplifier AS45A or AS45B.

| | |
|---|---|
| R1 contacts switch: | R1-1 closes locking up R1 relay; |
| | R1-2 closes in open first set of traffic light circuits TL1, green in 45, red in 46 direction (R61-2 remains open); |
| | R1-3 closes in the open T1 timer circuit starting up T1 timer switch; |
| | R1-4 closes in R5 relay's open circuit (R3-4 remains open); |
| T1 contact switches: | T1-1 opens briefly after 0.2 second de-energizing R3 relay; |
| R3 contacts switch: | R3-1 opens removing the lock from R3 relay; |
| | R3-2 closes in R8 relay's open circuit (R6-2 remain open, R61-1 closed); |

-continued

| | |
|---|---|
| | R3-3 closes in R9 relay's open circuit (R5-3 R51-1 remain open); |
| | R3-4 closes energizing R5 relay via R1-4, R6-5; |
| | R3-5 closes in R6 relay's circuit (R5-5 opens, R6-1 remain open, R2-4 closed); |
| R5 contacts switch: | R5-1 closes locking up R5 relay; |
| | R5-2 closes bypassing T1-3 timer contacts in R1 relay's circuit; |
| | R5-3 closes in R9 relay's open circuit (R51-1 open); |
| | R5-5 opens in lR6 relay's circuit to keep it open (R2-4, R3-5 closed); |
| | R5-6 opens switching off the green in the active second set of traffic lights TL2, green in 46 direction; |
| | R5-4 closes switching over the second set of traffic lights TL2 (from green) to yellow in 46 direction; |
| T1 contacts switch: | T1-3 opens briefly after 3 seconds with no effect (bypassed by R5-2); |
| | T1-4 opens briefly after 3 seconds de-energizing R2 relay; |
| | T1-2 opens after 4 second running time de-energizing T1 timer switch stopping it in starting position, |
| R2 contacts switch back into de-energized positions after 2.3 seconds: | R2-1 opens removing the lock from R2 relay; |
| | R2-2 opens switching off the second set of traffic light circuits TL2, green in 46, red in 45 direction, and de-energizes R61 relay; |
| | R2-3 opens in open T1 timer circuit; |
| | R2-4 opens in R6 relay's open circuit (R5-5, R6-1 remain open); |
| R61 contacts switch: | R61-1 opens in R8 relay's open circuit (R6-2 remains open); |
| | R61-2 closes switching on the first set of traffic light circuits TL1, green in 45, red in 46 direction, and energizes R51 relay. |
| R51 contacts switch: | R51-2 opens in the already interrupted second set of traffic light circuits TL2, green in 46 direction; |
| | R51-1 closes energizing R9 relay via R5-3; |
| R9 contact switches: | R9-1 closes starting up T2 timer switch; |
| | R9-2 opens interrupting R2 relay's open circuit preventing the premature switching of the traffic lights. |

Figure 7:
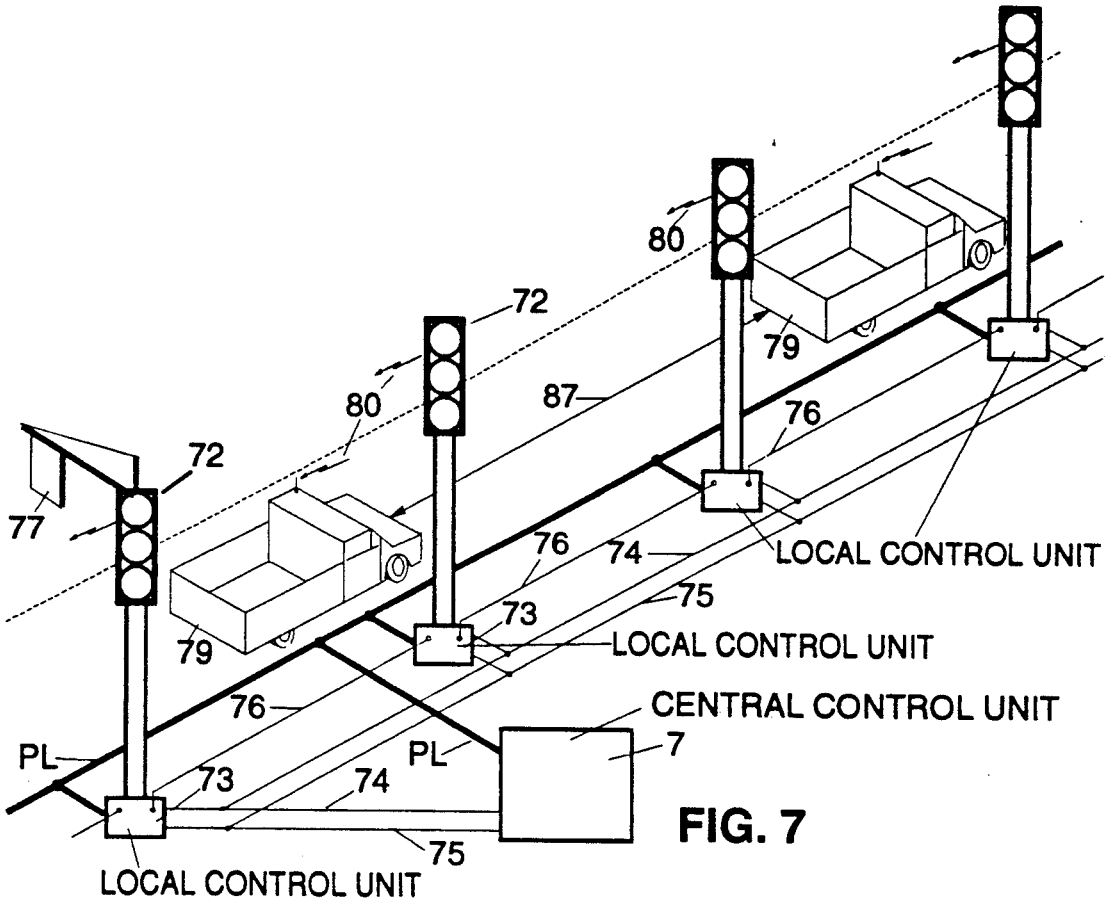
FIG. 7 shows the block diagram of the control circuit may be used in any one of the embodiments of FIGS. 1, 2, and 3.

FIG. 7 illustrate the layout and a block diagram of a control system for an exemplary embodiment of a signal progression system built with electro-mechanical components. (Described in details in connection with FIG. 12 and 13.) Any existing control system known in the art for the purpose can be used; the up-to-date solid state technology has definite advantages in cost, reliability, and lower maintenance requirements. The electro-mechanical system, however, offers better chance to follow the operation of the system.

Figure 8:
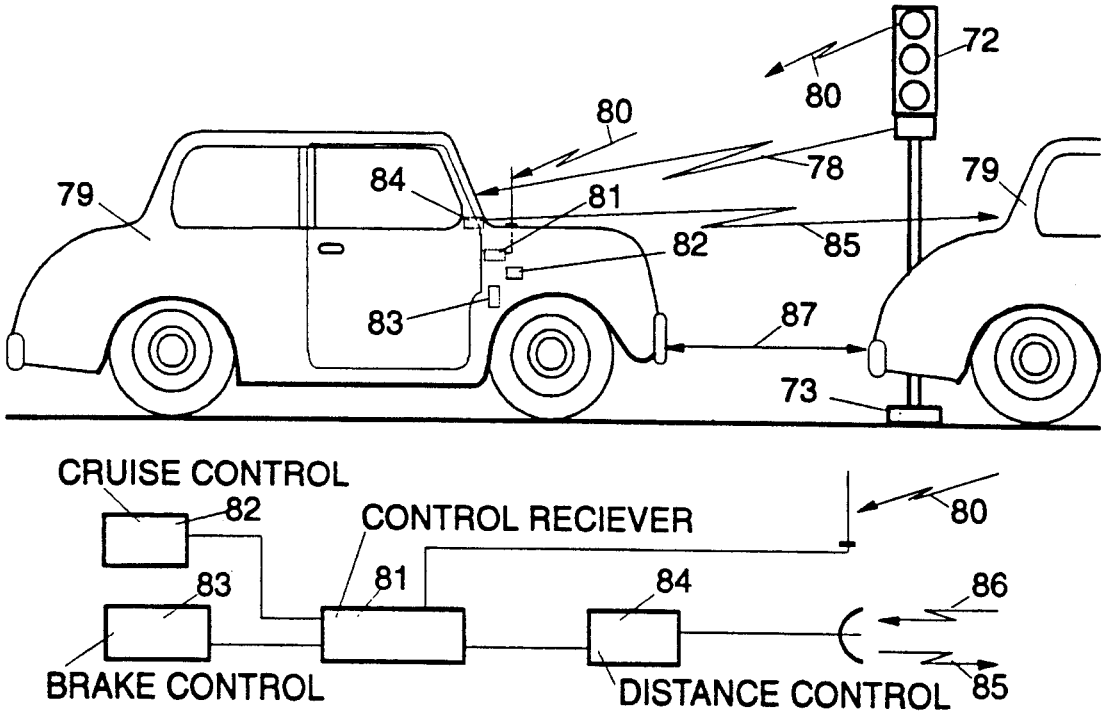
FIG. 8 shows the block diagram of the control of an automated vehicle.

In FIG. 8, a more advanced version is presented, having roadside radars for checking the vehicles' speed. The results of the comparison with the nonstop speed at the location, and emergency warning signals are carried to the vehicles by modulated narrow beams of the electro-magnetic spectrum (including the infrared and microwave ranges) from transmitters accommodated along the street. The beams are received and decoded by control receiver accommodated on the advanced vehicles. The control receiver adjust the velocity of the vehicles by adjusting its cruise control device and its servo brake, automatically, relieving the drivers from the burden of this control. To complete the automatic setup, radar type distance control device is used for maintaining the adequate safe clearance between vehicles, overriding the velocity control. The radar type distance control device receives echoes from the preceding vehicle creating output for the same automatic control device for maintaining the desired preselected clearance on the front of said automated vehicle. The radar control can work safely also in poor visibility (fog, dust, rain etc.). In lanes where all the vehicles are equipped with this advanced system, the column moves smoothly, with no gaps, and without the driver's intervention, as if it would be a train assembly. The driver can override the automatic system any time. If some of the vehicles are driver operated on the basis of the light signals alone, smooth operation still can be maintained in a mixed system: those drivers maintain their vehicle's velocity, its position, and the adequate clearance on the basis of the visual control signals, and they are guided by the steady movement of the tightly controlled automated vehicles. It is obvious that this automated system is the ideal solution for fastroad operation.

Referring to FIGS. 7, 8 in details, central control unit 7 and signal emitting fixtures 72 are connected to power line PL. Local control units 73 are accommodated in the structure of each traffic light 72. The output of unit 7 is linked via lines 74, 75 with each local control units 73. At the beginning of each fastblock, a sign 77 is displayed showing the nonstop symbol and the nonstop speed for the block at the time. Signal emitting fixtures 72 also emit radar pulses 78 for checking the speed of passing vehicles. Comparing the speed with the nonstop speed at the point, the system emit control code 80 for control receivers 81 of the vehicles to adjust their cruise control system 82 and their brake control 83 as needed to comply with the speed requirements.

Vehicles 79 are also equipped with radar type distance control device 84 known in the art emitting pulses 85 and receiving echoes 86. If the measured clearance is deviating from the desired value, control receiver unit 81 adjusts cruise control 82 and brake control 83 as needed for restoring proper clearance 87. If in conflict, the clearance control overrides the cruise control.

Figure 9:
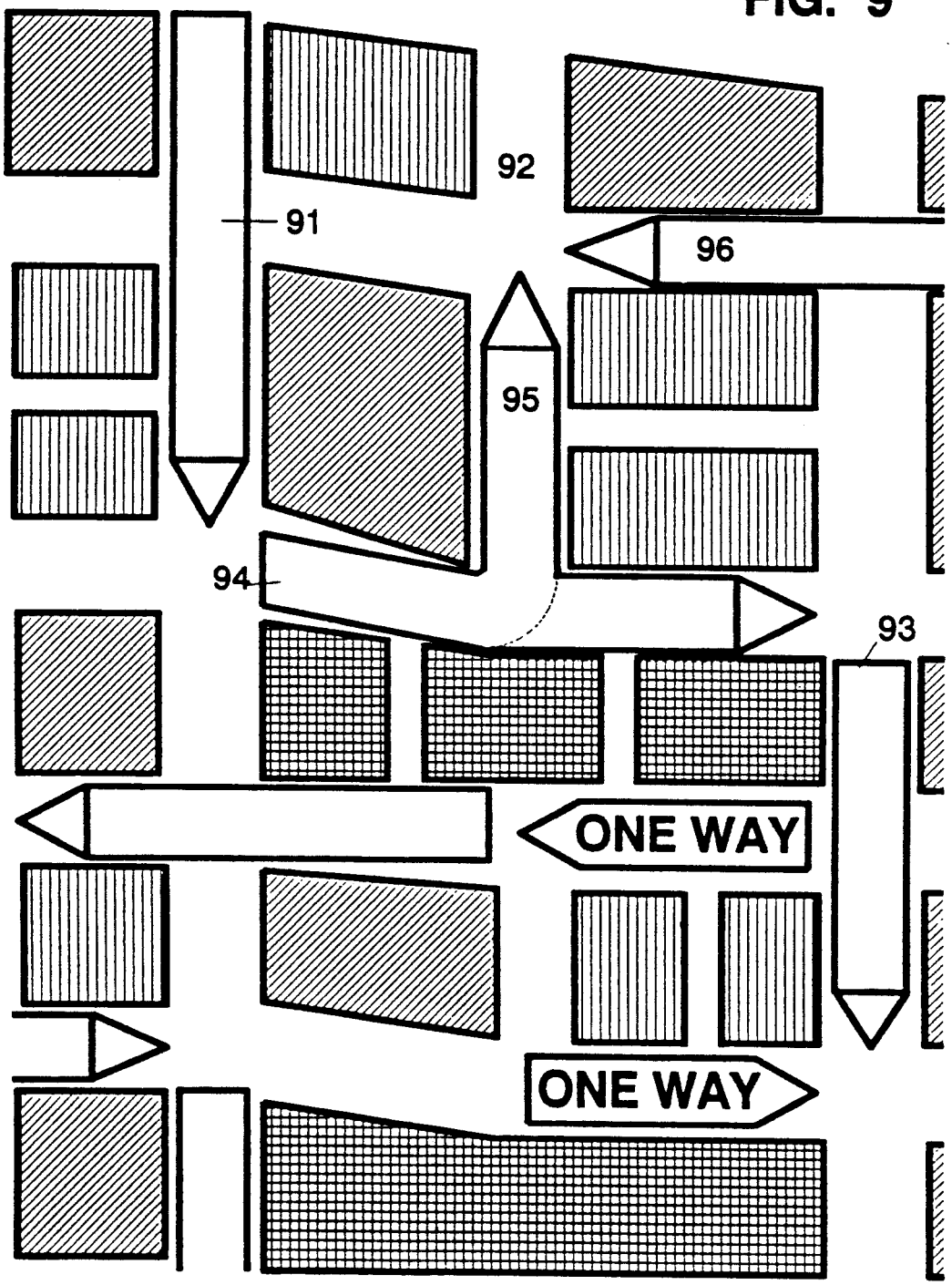
FIG. 9 shows the embodiments of FIG. 3 in an uneven grid of streets.

Referring to FIG. 9, there is shown a grid of streets displaying a high degree of irregularity. A one way fastroad system (similar to the one in FIG. 3) is adapted to it with some limitations. The length of the green zones (e.g., 91, 93) substantially differs, so does the nonstop speed of the zones. This difference, however, does not considerably restrain the advantages of the nonstop traffic flow. The average system speed can remain unchanged.

Street 92 is blocked by the irregularities southward, but northward is clear, and part of the platoon in green zone 94 turns left for taking advantage of a clear fastroad. The northward heading platoon in zone 95 however is in a red zone, and has to stop until the approaching green zone 96 passes through. From that point, however, the nonstop character is maintained.

Most streets have no more than two lanes for handling two way traffic, and two curb lanes for parking, loading, bus and taxi services. This is the minimum road size where a full-featured two way fastroad can be operated. FIG. 10 illustrates the operating of a two way fastroad of minimum size. The general pattern of the two way grid shown in FIG. 2 is still valid in this case. FIG. 10 shows one fastblock long section of the narrow two way fastroad.

The two middle lanes are nonstop lanes. The curb lanes used in the middle of the block for parking and loading, but they serve also as on and off ramps, and landing zones for very short use. Providing adequate landing zones for vehicles leaving the nonstop lane is useful because local parking and entering movements of these vehicles can be performed while the red zone is moving through and the nonstop lane is empty. Thus the traffic is not hindered.

It is safe and advantageous to move a vehicle on a nonstop lane to its destination while the vacate zone is passing through. This destination can be a parking space parallel to a curb, a drive way, or a loading ramp. The following four steps can be used: 1. passing the selected destination 2. exiting the nonstop lane and entering into the closest landing zone; 3. waiting for the arrival of the vacate zone; 4. backing into the destination while the vacate zone passing through.

In northbound nonstop lane, green zone 100 moves northward containing eight vehicles within the portion of the fastblock shown. On the southbound lane, the tail end of the southbound green zone 101 is shown, followed by yellow zone 102. The rest of the southbound lane is mostly empty, being the vacate zone.

On ramps 103 are part of the curb lane at the beginning of the block. Off ramps are at the end of the block. They are no parking zones. The entering vehicles wait here for the arrival of the end of the green zone for merging into it. Buses, emergency and public service vehicles are permitted to merge in front of the green zone and take up the role of the leading vehicle in the platoon.

If there is no space left in the green zone, no vehicle can enter the nonstop lane. They must wait for the next green zone. Light 104, well visible from the on ramp, marks the approaching end of the green zone by flashing. When it turns red, no entry is permitted. This entry method protects the fastroad system against saturation and gridlock. When a large number of vehicles approaches the on ramps, they may fill up the streets leading to the on ramps; all green zones may be filled up to capacity, but fastroads remain running nonstop all the time.

Off ramps 105 are at the far end of each block. They are no parking zones. Just before the off ramps, landing zones 106 are provided where vehicles can exit from the platoon and wait for the passing of the green zone. The front end of landing zones 106 is reserved for bus stops. While the red (vacate) zone is passing through, vehicles can back into drive ways, as vehicle 107, or park parallel into a space they passed in the block, without interrupting any traffic, as it happens in the present system.

Northbound vehicle 108, moved over to the opposite nonstop lane in the red zone, using it as a nonstop left turn lane. This can be safely done because by the time the incoming southbound platoon arrives with the green zone to the drive way where vehicle 107 backed in, the tail end of northbound green zone 100 reaches the middle of pedestrian island 109. Left turn arrow 110 indicates the time frame for left turns. When the end of green zone 100 reaches the south end of island 109, arrow 110 there is already turned off to keep adequately safe clearance between left turning vehicles and the incoming southbound green zone. The safe clearance can be increased by moving lights 104 closer to on ramps 103, delaying the progress of the signals at that portion of the road. This delay has the additional increase of safety by decreasing the merging speed for vehicles waiting on ramps 103 for entering the nonstop lane.

The only place is midway between nonstop intersections where left turns can be allowed in two way fastroad. And at this point, as illustrated in FIG. 10, no left turn lane is needed to perform nonstop left turns. The conclusion is that fastroad does not need left turn lanes, unless the road must be divided, as shown in FIG. 1. An alternate way to make a left turn in two way traffic is exiting to the right and driving around the block as represented by vehicle 111.

If an emergency vehicle needs to run faster than the nonstop speed, it uses its siren to stop the traffic. If the platoons stopped in the position shown in FIG. 2, the emergency vehicle can drive freely through by using the red zones on both side of the road. The general rule is to move away from the center of the road as far as possible, using on- and off ramps, landing zones and empty parking spaces, even drive ways and cross streets. After the emergency vehicle passed, they reenter into the next green zone, merging into its tail end as space is available.

FIG. 10 shows the minimum number of traffic lights: one at each crossing, and another one 104 at half way in between. Light 104 has the most important role: it controls the entry into the nonstop lane from the on ramp preventing saturation.

Pedestrian crossing in the fastroad system is safer. At nonstop intersections, there are no left turning vehicles. They can cross with the movement of the green zones. At any other point of the road, it is easy to set up light controlled pedestrian crossing in two steps: for each side of the road, with an island (e.g., 109) at the center. When the green zone passed, the entire time of the red zone is available for crossing.

The minimum road space for fastroad is three lanes in one way traffic. FIG. 11 is illustrating an exemplary embodiment: a two fastblock long portion of a single lane fastroad with one service lane on both sides. On the center of the road, in northbound nonstop lane, in green zone 112 ten vehicles are travelling northward. The layout of the zones in the grid is the same as in FIG. 3. At the front end of the platoon, on the center lane, the tail end of westbound green zone 113 is shown followed by yellow zone 114. At the tail end of the platoon, at the end of yellow zone 115, the front end of a westbound green zone 120 is shown. A third, eastbound fastroad is shown at the center. It is empty; the red zone is moving through. On the curb lane, parked vehicle 116.1 is preparing for making a left turn to travel north. On the east side, two vehicles 115.2 are waiting for the eastbound green zone to enter after completing a right turn. At the middle of the north block, on a two way side street vehicle 116 travels eastward, and vehicle 117 travels westward after exiting the northbound fastroad. Vehicle 118 is waiting for the arrival of the northbound red zone when a crossing of the fastroad can be performed.

On and off ramps, parking, and landing zones 119 are provided the same way as in FIG. 10. In one way system, there are no restrictions for turning or crossing (except the orientation of the one way), neither for vehicles, nor pedestrians. The lights controlling regular cross traffic are synchronized with the moving of the zones.

Traffic light requirements are the same: one on each street corner, and one at half way in between. If the blocks are not too long, and the entering drivers can see the next light on the corner while waiting for entering the green zone, existing signal progression system can be converted to fastroad without adding any hardware. Only the publication of the fastroad rules are necessary: 1. entering into nonstop lanes only at the presence of green zones; 2. vacating red zones; 3. lead vehicle keeps up with the progression of the green lights; 4. subsequent vehicles following with minimum safe clearance if the traffic is heavy. By following these simple rules, every existing one way signal progression system can be converted to nonstop traffic and protected from saturation and gridlock without installing anything.

If the nonstop speed significantly varies in certain portions of the road, or automatically adjusted according to environmental and traffic conditions, displaying the speed values helps assuring the smooth operation of the system where new speed is introduced. The most advanced way is to communicate the speed by using short range broadcasting to adjust the automatic cruise control of the vehicles, bypassing the driver.

There are several known techniques to directly indicate the compliance with the desired speed values: installing stroboscopic speed indicators at selected portions of the road, or introducing synchronized coded blinking into the zone marker traffic lights to make the speed of the progression of the signals easier noticeable. These measures, however, are seldom needed.

In areas where traffic congestion is the way of life, it is useful to aid drivers to fill up the green zones to capacity. This can be done by introducing coded blinking into the green zone marker lights when sensors report low vehicle count. The best solution is the automatic speed control combined with radar based clearance control, bypassing the drivers described in connection with FIGS. 7, 8.

Figure 12:
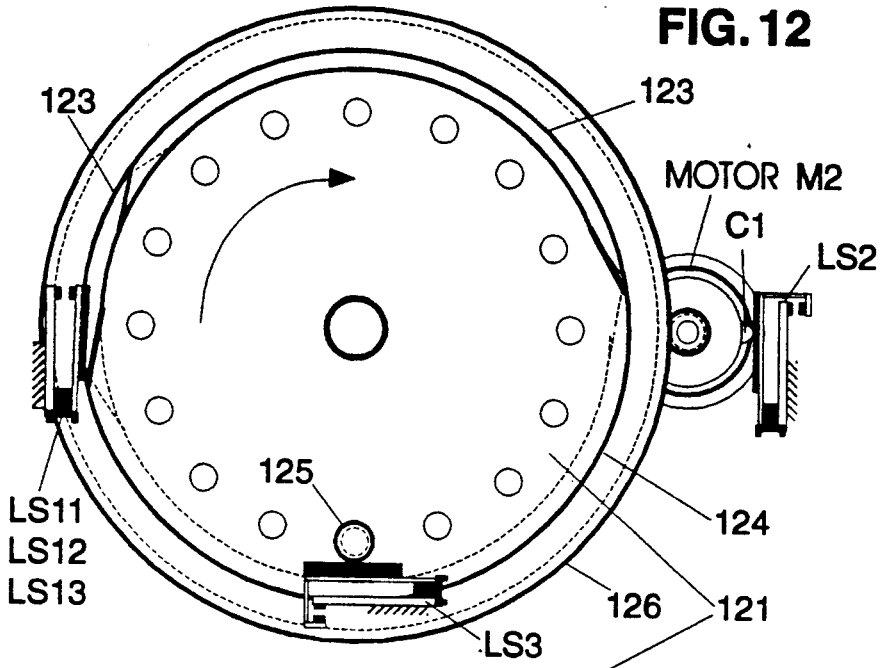
FIG. 12 shows the side elevation view of a possible embodiment of a sequential control device for controlling traffic lights in signal progression systems.
Figure 13:
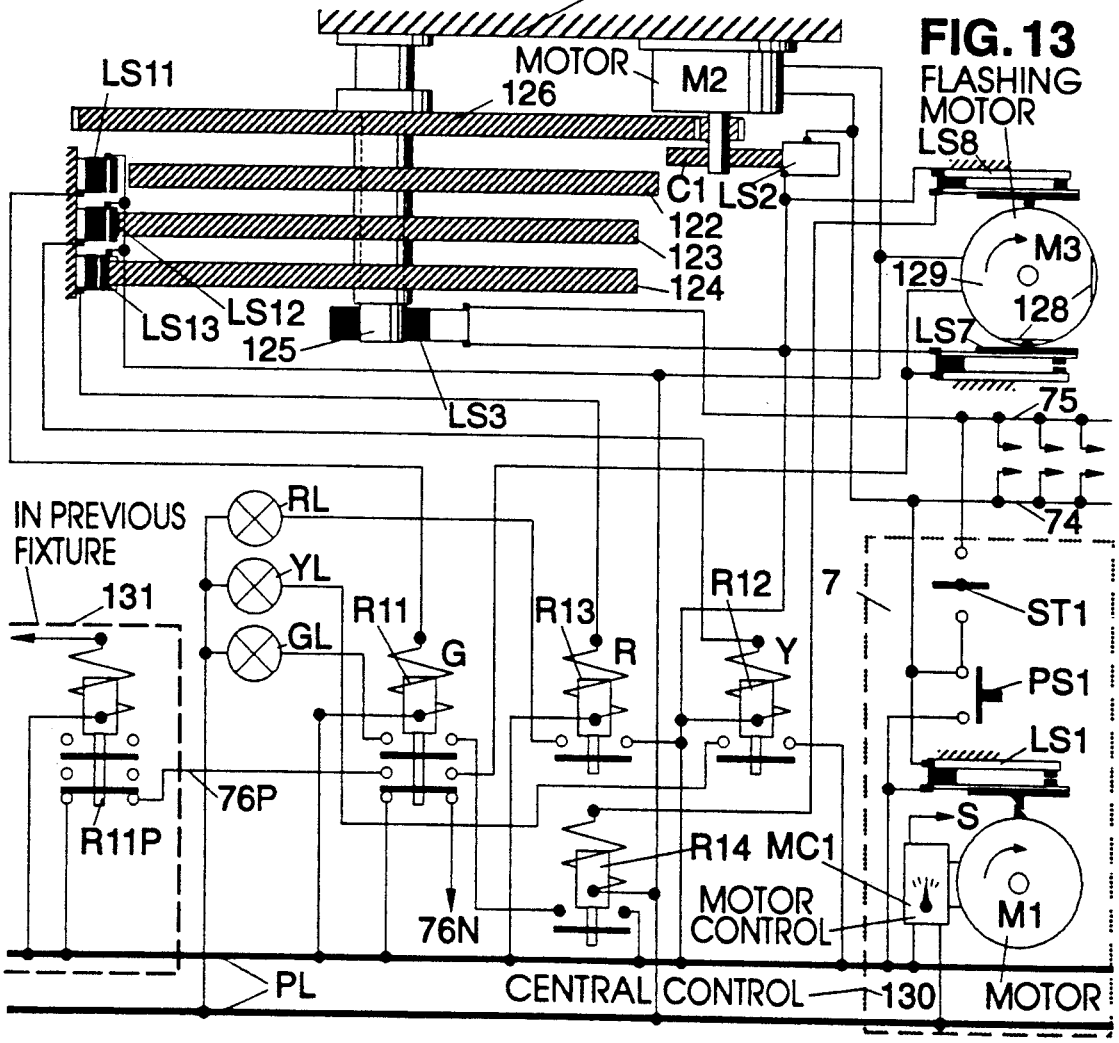
FIG. 13 shows the plan view and the schematic diagram of the embodiment of FIG. 12.

FIGS. 12 and 13 illustrate the details of an exemplary embodiment of an electro-mechanical control device (73 in FIGS. 7, 8) for the local control of a traffic light (72) operating in a string of lights under central control (e.g., 7) in accordance with the principles of the signal progression system. It has been designed to operate in a sixteen light signal chain which is repeated along the road: six green lights followed by two yellow lights, then eight red lights. The design also provides for flashing the last green light in the chain, and it includes a central starting alignment feature.

Local control unit 73 is connected to the same power line PL as central control unit 7 and all the traffic lights. It is controlled by central control unit 7 via pulse line 74. Second line 75 is provided for aligning the lights in their correct starting position. Two subsequent lights 72 are interconnected with line 76 for providing the clue for the flashing circuit to initiate the flashing of the last green signal in the zone.

The main component of the control system is rotary cam switch 121 operated by motor M2 one turn at a time. Three cam discs 122, 123, 124 operate three leaf switches LS11, LS12, LS13 and a movable pin 125 operates fourth leaf switch LS3. Driving motor M2 is geared to cam drive wheel 126 with a ratio for rotating the cam shaft by 1/16 while turning once. Motor M2 has its own cam disc C1 to operate switch LS2. It closes after motor M2 started up by a cycling pulse received from central control 7. After completing one turn, LS2 interrupts the circuit of motor M2 when it returned to its starting position.

In the exemplary embodiment shown in FIGS. 12, 13 cam switch 121 designed for sixteen steps: there are sixteen holes drilled into cam disc 124. Each can receive movable pin 125. The selection of the hole determines the position of the signal emitting fixture in the signal progression system, and it is set up for the desired position at the initial installation. After receiving a pulse from central control 7 via line 74, motor M2 starts up in each local control unit 73 and completes one turn, moving the cam disc assembly by 1/16 turn. Switch LS11 operated by disc 122. This disc has larger radius on 6/16 of the circumference, switching on green light GL for six cycles. At the next two cycles, disc 123 has the larger radius, closing LS12 switch for yellow light YL. During the remaining eight cycles, switch LS13 is closed by disc 124 in the same manner for red light RL.

Since the lights require the switching of heavier currents than the cam switch can handle, it operates through three relays: R11, R12, R13. A fourth relay R14 performs the operation of flashing green light GL. When relay R11P is de-energized (turning the green light off) in the previous fixture in the chain (symbolized by envelop 131), it closes its third contact. This contact is in series (via line 76P) with the second contact of relay R11 (which is closed already when R11 is energized switching on green light GL), closing the circuit of flashing motor M3. Motor M3 turns cam disc 129 once in two seconds. At the starting (and non-flashing) position, LS8 switch is closed energizing R14 relay: the green light is on. Two asymmetrical indents 128 on cam disc 129 introduce two recognizable interruptions per turn in the green light (both in the first second, and none in the second) to warn slow drivers that they are about to loose the green zone. When cam 122 de-energizes relay R11, its second contact would interrupt M3 motor's circuit if switch LS7 would be open. LS7 can be open only when one of indents 128 lined up with switch LS7. The asymmetrical placement of indents 128 guarantees that when LS7 stops motor M3, switch LS8 is closed. Thus next time when switch LS11 energizes relay R11, relay R14 is closed by switch LS8, and the green light comes on. Relay R11 also provides a normally closed contact for the next fixture in the chain via line 76N for starting the flashing there when relay R11 is de-energized (and green light GL is turned off).

In FIG. 13 enclosure 130 symbolizes central control unit 7. In this embodiment, the cycling pulse is generated by motor M1 and leaf switch LS1. Motor M1 is energized through motor control unit MC1 which provides for manual control for adjusting the speed, and may have processors for evaluating sensor input (from line S) for determining the optimum frequency of the cycling. There is a push button test switch PS1 in the circuit for cycling the system manually, and a manual start up switch ST1 which bypasses switch LS2 which stops motor M2 normally. When switch ST1 is closed, motor M2 keeps running in every fixture in the chain until pin 125 opens switch LS3. Thus every traffic light find its position in the progression chain automatically, if some interruption of the operation disturbed the normal sequence of the lights.

SUMMARY, RAMIFICATIONS, AND SCOPE

It can be seen from the above description that a nonstop traffic control system is feasible and safe not only on wider streets with heavy traffic, but also on narrower roads, with less interference from local service activities, e.g., parking, entering drive ways or loading ramps. On regions having light traffic controlled by stop signs and no central control, or even no power lines, locally controlled quasi-nonstop traffic can be established.

The centrally controlled nonstop system can be installed gradually; e.g., first on a single main thoroughfare, without sensors, with fixed velocity, and only on one lane. In this arrangement, only the traffic lights of the cross streets should be synchronized with the passing of the zones. Later the other lanes and the crossing fastroads can be added one by one. Finally, the sensors along the streets can be installed, if the increase of congestion makes it justifiable. Additional optimizing of the system regarding the velocity and safety also can be offered by including sensor input for congestion, road surface and weather conditions in the process of determining the safe system speed.

The greatest advantage in fastroad system can be achieved with one way traffic. It can handle heavier traffic for the same road space. The green zone is twice as long, thus the proportion of the yellow zone going down to the half. There are no turning or crossing restrictions neither for vehicles nor for pedestrians. The narrowest full featured fastroad (three lanes) can be arranged for one way traffic.

The fastroad systems do not require left turn lanes. In two way traffic, nonstop left turn can be performed at midway between nonstop intersections by using the nonstop lane of the opposing traffic as temporary left turn lane while the vacate zone is passing through in the lane of the opposing traffic at the given point. This move is safe, since the opposing platoon is a block away, and left turn signal can be set up to limit the time frame. Left turns, however, can also be accomplished by driving around a right loop. Nonstop U-turn can also be permitted on roads which are wide enough.

Transition zones can be used at both ends of the travel zones, or only at the front or rear end. To achieve optimum capacity of the fastroad, their length can be controlled by central control device 7 on the basis of input from sensors, or from humans, or both.

The traffic sensors along the street also can be embedded in the pavement. Sensors for more general information (road surface, weather, etc.) can be housed centrally in several locations in the region.

Zone end and gap marker signals can be represented the easiest by coded flashing of the green lights.

Any fast communication channels (e.g., microwave, coaxial cable, fiber optics, etc.) can be used between central control device 7 and fixtures 6, 72, 104.

In case of general acceptance, the electro-mechanical control devices (FIG. 6, 12, 13) can be economically substituted with solid state devices. In large quantities, the cost can be reduced to the level of a better pocket radio set. The reliability incomparably increases, and hardly any maintenance is needed.

The carrier medium for the emitted control signals may vary in advanced systems, even mixed media can be used, without transgressing the scope of the present invention.

To eliminate stop signs and traffic lights on narrow streets with occasional local traffic, the more important nonstop street can be marked by a square (with its diagonal in vertical position, according to international usage) to designate its nonstop character, and the less important street—having yield signs at intersections—can rely on mirrors placed over the intersections to reveal the traffic situation on the cross street and allow nonstop crossing or turning whenever the cross street is empty. These mirrors should provide moderately reduced undistorted view in both directions.

The described systems require investment in equipment and driver education. All these investments, however, are negligible compared with the following substantial advantages:

1. Up to 50% savings can be achieved in fuel consumption in city driving. The internal combustion engine converts the energy of the fuel into the kinetic energy of the vehicle when accelerating. When decelerating and stopping, the whole kinetic energy is converted into waste heat in the brakes. The best way to control traffic is keeping safe distance between vehicles moving across one another's path, but doing it without stopping. The maintenance of steady velocity requires much less energy, thus much less fuel.

2. Air pollution is reduced proportionally to the reduced fuel consumption. The greenhouse gas contribution is reduced in the same extent.

3. Driving time can be substantially reduced by keeping the traffic moving with reasonable velocity, without facing red lights or stop signs. Even left turns or U-turns are feasible without stopping and waiting.

4. City driving in the proposed traffic control system becomes a less tiring and frustrating experience. Consequently, it leads to fewer accidents, lower insurance rates, and infrequent health problems.

The above description should not be construed as limiting the scope of the invention but merely as providing illustrations of some of the presently preferred embodiments of the invention. Thus the scope of the invention should be determined by the appended claims and their legal equivalents, rather than by the examples given.

What is claimed is:

1. A method for controlling city traffic with reduced stopping in at least one nonstop lane of at least one designated road, comprising the steps of:

(A) establishing a centrally controlled signal progression system along said road by (A1) installing a plurality of signal emitting fixtures disposed along said road, each adapted to alternately emit one of three signals, (A2) installing a plurality of local control means, each one interconnected with one of said fixtures, for switching said fixtures to create three strings of said three signals following one another along said road: a first string comprising a first number of consecutive fixtures emitting the first one of said three signals, a second string comprising a second number of consecutive fixtures emitting the second one of said three signals, and a third string comprising a third number of consecutive fixtures emitting the third one of said three signals, said three string of signals marking three distinct zones, a travel zone, a vacate zone, and a transition zone following one another along said road in repeated sequences, (A3) installing central control means for generating control signals in cycles forwarded through interconnections to each said local control means for prompting them to perform step by step switching operations in each cycle in unison inducing a forward step in each said local control means for progressing the position of each said fixture in said signal progression system by one step in each cycle, causing each signal to jump from each said fixture to the next in each step thereby effecting each zone to move in increments with the progression of said signals, (A4) designating said travel zones for vehicular traffic steadily moving exclusively within said travel zones in said nonstop lane including intersections, (B) permitting the entry of vehicles into said nonstop lane only in periods when the next signal emitting fixture in forward direction prompted by said local control means to emit the signal of said travel zones whereby preventing the development of congestion and maintaining a steady flow on said nonstop lane.

2. A method for controlling city traffic as claimed in claim 1 including the additional step of permanently authorizing the presence of vehicles only in said travel zones of said nonstop lane, temporarily admitting vehicles in said transition zones and vacate zones within the length of a fastblock said fastblock being the distance between two subsequent nonstop intersections, excluding the area of the intersections, and obliging all vehicles outside of said travel zones to leave said nonstop lane before said local control means starts switching on said fixtures in said fastblock to emit the signal of said travel zone.

3. A method for controlling city traffic as claimed in claim 1 including the additional step of controlling the traffic flow on a multiplicity of roads forming a grid, said vehicular traffic travelling in said travel zones with nonstop speed passing every nonstop intersection through said vacate zones of a cross traffic with safety provided by said transition zones.

4. A method for controlling city traffic as claimed in claim 2 including the additional step of installing the same number of fixtures in every fastblock, each said fixture interconnected with one of said local control means operated by said central control means with the same frequency of switching cycles throughout said grid under central control thereby establishing an average speed of the progression of said zones in every fastblock, said nonstop speed, proportionally to the length of each said fastblock.

5. A method for controlling city traffic as claimed in claim 1 including the additional step of requiring a leading vehicle in said nonstop lane of said travel zone to keep up with the progression of the first signal of said travel zone, and each following vehicle to keep minimum safe clearance from the preceding vehicle whereby said travel zone can be filled up to capacity maximizing the traffic flow.

6. A method for controlling city traffic as claimed in claim 1 including the additional step of providing landing zones for vehicles leaving the nonstop lane for performing local parking and entering movements without hindering said traffic flow, during a period when said signal emitting fixtures, prompted by said local control means, emit the signal of said vacate zone in the given fastblock, and said nonstop lane carries no traffic.

7. A method for controlling city traffic as claimed in claim 6 including the additional step of parking a vehicle parallel to a curb using said nonstop lane for performing the following steps: (1) passing a selected parking space; (2) exiting said nonstop lane and entering into the closest landing zone; (3) waiting for the period when said signal emitting fixtures prompted by said local control means emit the signal of said vacate zone in the given fastblock; (4) backing into said parking space while the signal of said vacate zone is emitted by said fixtures.

8. A method for controlling city traffic as claimed in claim 1 including the additional step of providing a designated opening in a two way traffic system at midway between two subsequent nonstop intersections for performing nonstop left turn and U-turn without hindering said traffic flow while said signal emitting fixtures prompted by said local control means emit the signal of said vacate zone for the opposing traffic in the given fastblock.

9. A method for controlling city traffic as claimed in claim 8 including the additional step of performing a nonstop left turn in two way traffic system on a road having no left turn lane by using the nonstop lane of said opposing traffic as a temporary left turn lane without hindering said traffic flow while said signal emitting fixtures prompted by said local control means emit the signal of said vacate zone for said opposing traffic in the given fastblock.

10. A method for controlling city traffic as claimed in claim 1 including the additional step of installing means for inserting a coded blinking into said emitted signals of said travel zone for encouraging the drivers to follow the preceding vehicle with the minimum safe clearance when vehicles waiting for entry at on ramps, and for marking the last signal in said travel zone with a different code.

11. A method for controlling city traffic as claimed in claim 1 including the additional step of arranging the length of said zones in two way traffic that the length of said travel zone plus said transition zone is substantially equal to the length of said fastblock, and the length of said vacate zone is substantially equal to the length of said fastblock plus the sum of the width of two crossing fastroads enclosing said fastblock, and the minimum length of said transition zone is equal to the safe braking distance at said nonstop speed at existing road conditions.

12. A method for controlling city traffic as claimed in claim 11 including the additional step of arranging a starting position of said zones in a selected point in time to form a square having clockwise orientation in their loop in right hand driving traffic systems, said squares alternating in a checkerboard pattern in said grid under central control.

13. A method for controlling city traffic as claimed in claim 1 including the additional step of arranging the length of said zones in one way traffic that the length of said travel zone plus said transition zone is substantially equal to the sum of the length of said two fastblocks plus the width of the crossing fastroad separating said two fastblocks, and the length of said vacate zone is substantially equal to the sum of the length of said two fastblocks plus the width of said crossing fastroad separating said two fastblocks, plus the sum of the width of the two crossing fastroads enclosing said two fastblocks, and the minimum length of said transition zone is equal to the safe braking distance at said nonstop speed at existing road conditions.

14. A method for controlling city traffic as claimed in claim 13 including the additional step of arranging a starting position of said travel zones in a selected point in time to form two alternating zigzag patterns in said grid leaning diagonally in southwest-northeast direction where said first pattern has southwest orientation, said second pattern has northeast orientation.

15. A method for controlling city traffic as claimed in claim 1 including the additional step of disposing sensor means along said at least one designated road having interconnections to said central control means, for generating input signals when triggered by passing vehicles and environmental conditions, prompting said central control means for surveying the traffic congestion, weather and road surface conditions in said grid and for adapting a system speed accordingly by adjusting a frequency of the switching operations for establishing and maintaining the optimum safe velocity for the controlled roads under the prevailing driving conditions whereby operating said system safely and a most advantageously.

16. A method for controlling city traffic as claimed in claim 1 including the additional step of installing signal emitter means in said fixtures for emitting a set of signals carried by narrow beams of the electromagnetic spectrum and admitting at least one automated vehicle in said travel zone equipped with control receiver means for receiving and processing said signals received from said signal emitting fixtures, said control receiver interconnected with automatic control means adapted for controlling the velocity and relative position of said automated vehicle in said travel zone by adjusting its cruise control device and its brake control without the driver's intervention.

17. A method for controlling city traffic as claimed in claim 16 including the additional step of installing radar type distance control means for emitting pulses and receiving echoes from the preceding vehicle and providing control signal through interconnections for said automatic control means for controlling the velocity and relative position of said automated vehicle in said travel zone by adjusting its cruise control device and its brake control for maintaining a desired proper clearance on the front of said automated vehicle without the driver's intervention.

18. In a road traffic control system of the type having local control means for controlling vehicular traffic at a crossing of a first street and a second street and signal lights arranged at said crossing, facing each approach, adapted for emitting alternately red, green, and yellow light, controlled by said local control means responding to sensor input, comprising:

first, second, and third sensor means adapted for generating input signal each transmitted through an interconnection to said local control means via an amplifier when triggered by a passing vehicle, said first sensor means being accommodated on said first street, said second sensor means on said second street, one on each approach along said streets before said crossing, and said third sensor means being accommodated within said crossing, said first sensor means being adapted to generate input signal amplified by its amplifier, transmitted through said interconnection to said local control means when triggered by the passing of a first vehicle on said first street prompting said local control means to switch said signal lights to green for said first street, interlock circuit means connected to said local control means and adapted to be activated by said first sensor means via its amplifier, for preventing a change in said signal light output until said third sensor means within said crossing being triggered by the passing of said first vehicle through said crossing, releasing said interlock circuit means, said second sensor means adapted to generate input signal amplified by its amplifier, transmitted to said local control means through said interconnection when triggered by the passing of a second vehicle on said second street prompting said local control means to switch said signal lights to green for said second street, interlock circuit means connected to said local control means and adapted to be activated by said second sensor means via its amplifier, for preventing a change in said signal light output until said third sensor means within said crossing being triggered by the passing of said second vehicle through said crossing, releasing said interlock circuit means, timer means for executing an operating period after each switching of the orientation of said signal lights from one street to the other for releasing said interlock circuit means after a preset time delay elapsed whereby unnecessary stopping of said vehicles being avoided while uninterrupted traffic generally maintained.

* * * * *